US012584496B2

(12) United States Patent
Sheth et al.

(10) Patent No.: US 12,584,496 B2
(45) Date of Patent: Mar. 24, 2026

(54) HIGHER WORK OUTPUT CENTRIFUGAL PUMP STAGE

(71) Applicant: Halliburton Energy Services, Inc., Houston, TX (US)

(72) Inventors: Ketankumar Kantilal Sheth, Tulsa, OK (US); Donn J. Brown, Tulsa, OK (US); David McManus, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 53 days.

(21) Appl. No.: 18/197,373

(22) Filed: May 15, 2023

(65) Prior Publication Data

US 2024/0384729 A1 Nov. 21, 2024

(51) Int. Cl.
*F04D 29/44* (2006.01)
*E21B 43/12* (2006.01)
(Continued)

(52) U.S. Cl.
CPC ..... *F04D 29/448* (2013.01); *E21B 43/128* (2013.01); *F04D 13/10* (2013.01);
(Continued)

(58) Field of Classification Search
CPC ..... F04D 29/448; F04D 13/10; F04D 29/24; F04D 29/426; F04D 13/021; F04D 13/06;
(Continued)

(56) References Cited

U.S. PATENT DOCUMENTS 2,273,420 A * 2/1942 Schott ..... F04D 1/066 415/199.2
2,854,926 A * 10/1958 Haight ..... F04D 1/066 415/199.2
(Continued)

FOREIGN PATENT DOCUMENTS

JP 2020197148 A 12/2020
WO 2018170002 A1 9/2018
(Continued)

OTHER PUBLICATIONS

Foreign Communication from Related Application—International Search Report and Written Opinion of the International Searching Authority, International Application No. PCT/US2023/023186, dated Feb. 14, 2024, 12 pages.
(Continued)

*Primary Examiner* — David N Brandt
(74) *Attorney, Agent, or Firm* — Conley Rose, P.C.; Rodney B. Carroll

(57) ABSTRACT

An electric submersible pump (ESP) assembly. The ESP assembly comprises a centrifugal pump assembly comprising a plurality of pump stages, wherein each pump stage comprises a diffuser and an impeller, wherein the impeller comprises a plurality of impeller vanes, wherein each impeller vane comprises an impeller vane trailing edge that attaches to a shroud of the impeller at a location downstream of a location where the impeller vane trailing edge attaches to a hub of the impeller, and wherein the diffuser comprises a plurality of diffuser vanes, wherein each diffuser vane comprises a diffuser vane leading edge that attaches to a shroud of the diffuser at a location downstream of a location where the diffuser vane leading edge attaches to a hub of the diffuser.

23 Claims, 10 Drawing Sheets

(51) Int. Cl.

| | |
|---|---|
| ***F01D 9/04*** | (2006.01) |
| ***F04D 13/02*** | (2006.01) |
| ***F04D 13/06*** | (2006.01) |
| ***F04D 13/10*** | (2006.01) |
| ***F04D 29/24*** | (2006.01) |
| ***F04D 29/42*** | (2006.01) |
| ***F04D 29/54*** | (2006.01) |

(52) U.S. Cl.
CPC ..... *F04D 29/426* (2013.01); *F01D 9/042* (2013.01); *F04D 13/021* (2013.01); *F04D 13/06* (2013.01); *F04D 29/242* (2013.01); *F04D 29/444* (2013.01); *F04D 29/544* (2013.01)

(58) Field of Classification Search
CPC ..... F04D 29/242; F04D 29/44; F04D 29/444; F04D 29/542; F04D 29/544; F04D 1/06; E21B 43/128; F01D 9/042
See application file for complete search history.

(56) References Cited

U.S. PATENT DOCUMENTS

| | | | | |
|---|---|---|---|---|
| 4,678,399 | A | 7/1987 | Vandevier et al. | |
| 5,971,705 | A * | 10/1999 | Nagaoka | F04D 1/06 415/199.1 |
| 6,412,562 | B1 * | 7/2002 | Shaw | F04D 13/086 166/105 |
| 2009/0065202 | A1 * | 3/2009 | Brown | E21B 43/128 166/267 |
| 2010/0319926 | A1 | 12/2010 | Reid | |
| 2014/0322001 | A1 * | 10/2014 | Kushner | F04D 29/444 415/209.1 |
| 2015/0132159 | A1 | 5/2015 | Wilson et al. | |
| 2015/0204336 | A1 | 7/2015 | McManus et al. | |
| 2017/0051752 | A1 | 2/2017 | Gahlot et al. | |
| 2017/0122333 | A1 | 5/2017 | Gray et al. | |
| 2017/0241424 | A1 | 8/2017 | Patil et al. | |
| 2018/0291907 | A1 | 10/2018 | Ye et al. | |
| 2019/0017518 | A1 | 1/2019 | Brown et al. | |
| 2019/0024665 | A1 | 1/2019 | Ashurst et al. | |
| 2019/0040863 | A1 | 2/2019 | Davis et al. | |
| 2019/0162063 | A1 * | 5/2019 | Brown | F04D 13/10 |
| 2020/0347849 | A1 | 11/2020 | Ye et al. | |
| 2021/0140290 | A1 * | 5/2021 | Eslinger | E21B 43/128 |
| 2024/0384634 | A1 | 11/2024 | Brown et al. | |

FOREIGN PATENT DOCUMENTS

| | | | |
|---|---|---|---|
| WO | 2019165164 | A | 8/2019 |
| WO | 2021055689 | A1 | 3/2021 |
| WO | 2023012024 | A1 | 2/2023 |

OTHER PUBLICATIONS

Filing Receipt, Specification and Drawings for U.S. Appl. No. 18/748,839, entitled,Centrifugal Pump Stage With Radiused Impeller Flow Passage Exit for Reduced Erosion, filed Jun. 20, 2024, 52 pages.
Foreign Communication from Related Application—International Search Report and Written Opinion of the International Searching Authority, International Application No. PCT/US2025/013164, dated May 14, 2025, 13 pages.
First Office Action dated Dec. 16, 2025 (38 pages), U.S. Appl. No. 18/748,839, filed Jun. 20, 2024.

* cited by examiner

HIGHER WORK OUTPUT CENTRIFUGAL PUMP STAGE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Centrifugal pumps may be used in a wide variety of applications including electric submersible pumps (ESPs) and in horizontal pump systems (HPSs). ESPs may be disposed downhole in a wellbore to lift production fluid in the wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate. HPSs may be disposed in a horizontal position at the surface and may provide pumping pressure to fluids to cause these fluids to flow, for example to flow in a pipeline.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 6 is an illustration of a horizontal pump system (HPS) according to an embodiment of the disclosure.

DETAILED DESCRIPTION

Figure 1:
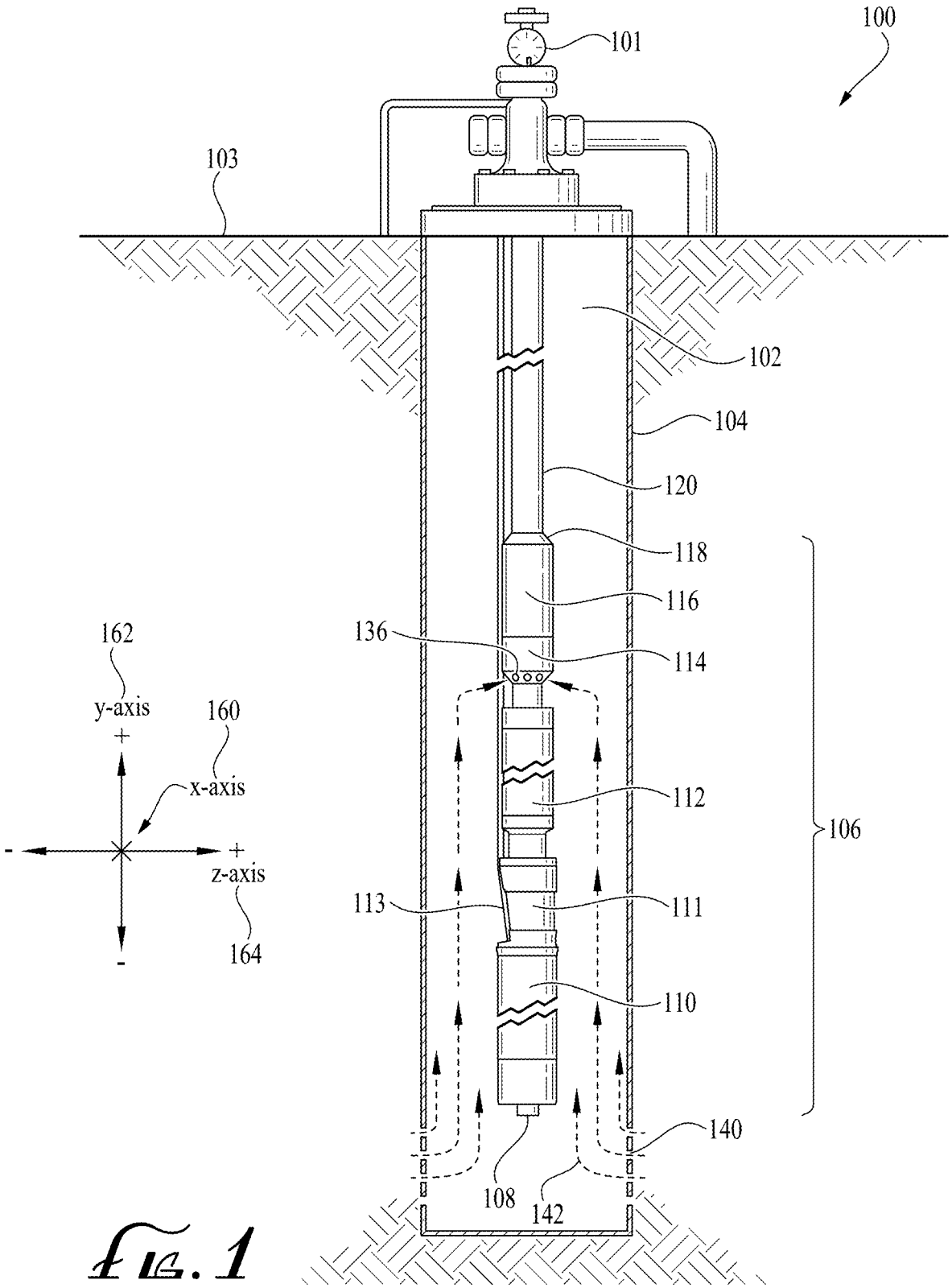
FIG. 1 is an illustration of an electric submersible pump (ESP) assembly disposed in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component. As used herein, the term "about" when referring to a measured value or fraction means a range of values+/−5% of the nominal value stated. Thus, "about 1 inch," in this sense of "about," means the range 0.95 inches to 1.05 inches, and "about 5000 PSI," in this sense of "about," means the range 4750 PSI to 5250 PSI. Thus, the fraction "about $^{8}/_{10}$s" means the range $^{76}/_{100}$s to $^{84}/_{100}$s.

The present disclosure teaches an improved centrifugal pump stage that provides a higher work output. More specifically, the disclosed centrifugal pump stage provides a higher work output (higher pressure at a given flow rate) than a conventional centrifugal pump stage with an equal diameter and an equal stage height (axial distance from bottom of stage to top of stage). This improvement is expected to be in the range from 5% to 15% increased pressure output per stage at a given fluid flow rate. For a given desired production flow rate and head (e.g., pressure) at the discharge of the centrifugal pump, a centrifugal pump assembly using the improved pump stage taught herein can use fewer number of pump stages than a centrifugal pump assembly using conventional pump stages. Using fewer number of pump stages to achieve the same output can increase the overall reliability of the centrifugal pump assembly, because the reduced number of pump stages leads to a reduced number of points of failure. This can reduce the axial length of the centrifugal pump assembly which may have advantages in tight wellbores. This can reduce manufacturing costs as less material may be employed to make the centrifugal pump assembly. Alternatively, a centrifugal pump assembly using the improved pump stage taught herein can produce a higher output pressure at the same flow rate as an equally sized centrifugal pump assembly using conventional pump stages (e.g., pump stages having impellers with impeller vanes of conventional configuration-vanes lacking the extension at the impeller vane trailing edge taught herein).

The higher work output is provided by extending an outside trailing edge of the impeller vanes downstream (the trailing edge where it attaches to the impeller shroud is further downstream than the trailing edge where it attaches to the impeller hub) relative to the conventionally configured impeller vane trailing edge. Because it is extended, the impeller vane trailing edge can transfer more kinetic energy (perform more work) on the fluid flowing through the impeller. This work is increased particularly because the outside edge of the impeller vanes—where the extension of the trailing edge of the vanes is maximum—is moving at the greatest linear speed. The angular speed is constant along the trailing edge, but the tangential speed is greatest at the outside edge of the impeller vanes. To accommodate the extension of the outside of the trailing edge of the impeller vanes, the leading edge of the diffuser vanes is shortened or retracted at the outside edge of the vane (the leading edge of the diffuser where it attaches to the diffuser shroud is further downstream than the leading edge where it attaches to the diffuser hub) relative to the conventionally configured diffuser vane leading edge. Thus, the modified diffuser vane leading edges may be said to mate with the modified impeller vane trailing edges.

Turning now to FIG. 1 a well site environment 100, according to one or more aspects of the disclosure, is described. The well site environment 100 comprises a wellbore 102 that is at least partially cased with casing 104. As depicted in FIG. 1, the wellbore 102 is substantially vertical, but the electric submersible pump (ESP) assembly 106 described herein also may be used in a wellbore 102 that has a deviated or horizontal portion. The well site environment 100 may be at an on-shore location or at an off-shore location. The ESP assembly 106 in an embodiment comprises an optional sensor package 108, an electric motor 110, a motor head 111 that couples the electric motor 110 to a seal unit 112, a fluid intake 114, and a centrifugal pump assembly 116. In an embodiment, the ESP assembly 106 may further comprise a gas separator assembly (not shown) that may be located between the fluid intake 114 and the centrifugal pump assembly 116. The centrifugal pump assembly 116 may couple to a production tubing 120 via a connector 118. An electric cable 113 may attach to the electric motor 110 and extend to the surface 103 to connect to an electric power source. The casing 104 and/or wellbore 102 may have perforations 140 that allow well fluid 142 to pass from the subterranean formation through the perforations 140 and into the wellbore 102. In some contexts, well fluid 142 may be referred to as reservoir fluid.

The well fluid 142 may flow downstream towards the ESP assembly 106 and into the fluid intake 114. The well fluid 142 may comprise a liquid phase fluid. The well fluid 142 may comprise a gas phase fluid mixed with a liquid phase fluid. The well fluid 142 may comprise only a gas phase fluid (e.g., simply gas). Over time, the gas-to-fluid ratio of the well fluid 142 may change dramatically. For example, in the circumstance of a horizontal or deviated wellbore, gas may build up in high points in the roof of the wellbore and after accumulating sufficiently may "burp" out of these high points and flow downstream to the ESP assembly 106 as what is commonly referred to as a gas slug. Thus, immediately before a gas slug arrives at the ESP assembly 106, the gas-to-fluid ratio of the well fluid 142 may be very low (e.g., the well fluid 142 at the ESP assembly 106 is mostly liquid phase fluid); when the gas slug arrives at the ESP assembly 106, the gas-to-fluid ratio is very high (e.g., the well fluid 142 at the ESP assembly 106 is entirely or almost entirely gas phase fluid); and after the gas slug has passed the ESP assembly 106, the gas-to-fluid ratio may again be very low (e.g., the well fluid 142 at the ESP assembly 106 is mostly liquid phase fluid).

Under normal operating conditions (e.g., well fluid 142 is flowing out of the perforations 140, the ESP assembly 106 is energized by electric power, the electric motor 110 is turning, and a gas slug is not present at the ESP assembly 106), the well fluid 142 enters the fluid intake 114, flows into the centrifugal pump assembly 116, and the centrifugal pump assembly 116 flows the fluid through the connector 118 and up the production tubing 120 to a wellhead 101 at the surface 103. The centrifugal pump assembly 116 provides pumping pressure or pump head to lift the well fluid 142 to the surface. In an embodiment, the centrifugal pump assembly 116 comprises improved impeller vanes and improved diffuser vanes, discussed further below with reference to FIG. 3, FIG. 4, FIG. 5A, FIG. 5B, and FIG. 5C, that provide increased pump pressure relative to conventional impellers and diffusers. The well fluid 142 may comprise hydrocarbons such as crude oil and/or natural gas. The well fluid 142 may comprise water. In a geothermal application, the well fluid 142 may comprise hot water. An orientation of the wellbore 102 and the ESP assembly 106 is illustrated in FIG. 1 by an x-axis 160, a y-axis 162, and a z-axis 164.

Figure 2:
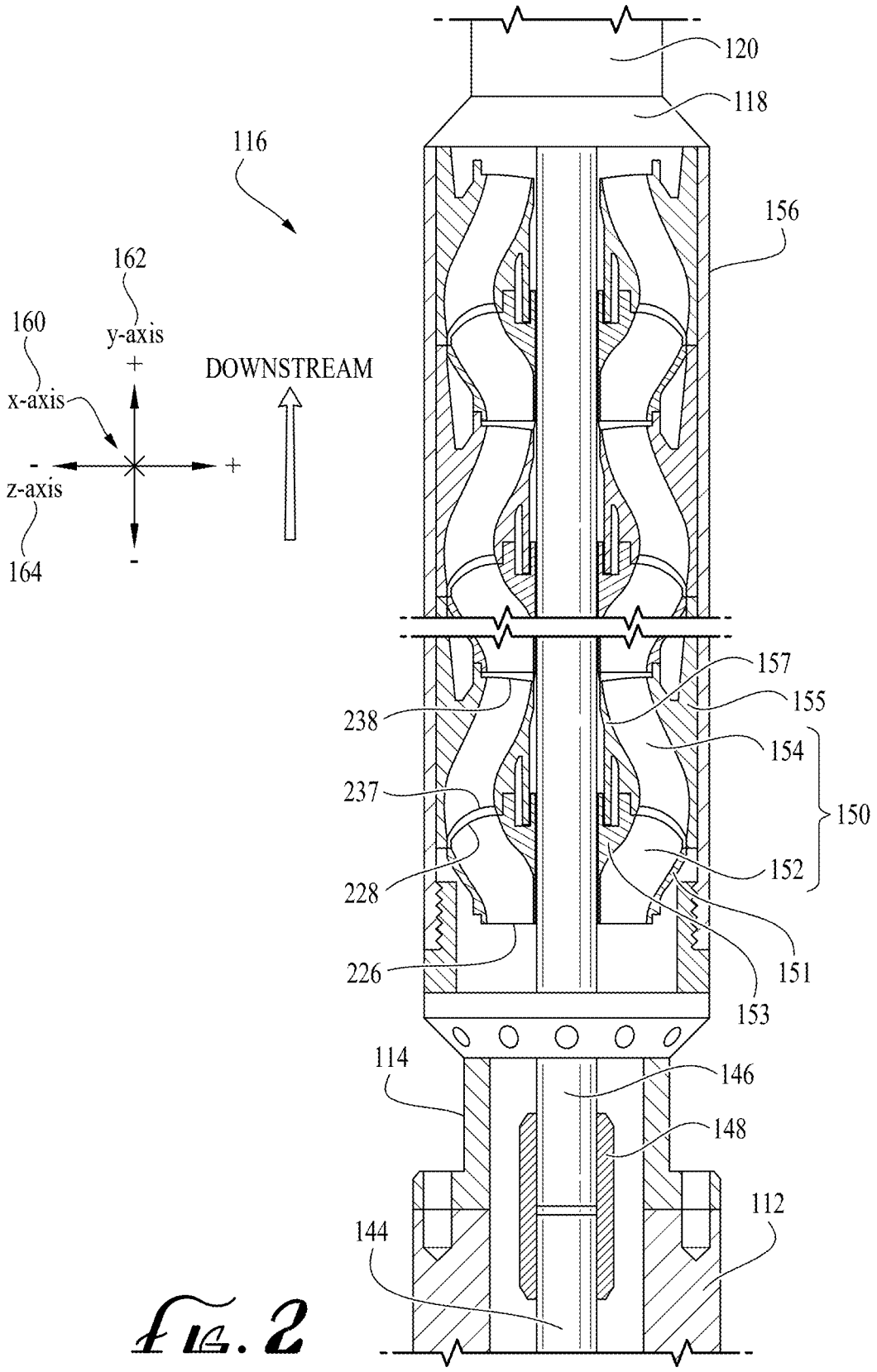
FIG. 2 is an illustration of a centrifugal pump assembly according to an embodiment of the disclosure.

Turning now to FIG. 2, further details of the centrifugal pump assembly 116 are described. A downhole end of the fluid intake 114 may be bolted to a head of the seal section 112. An uphole end of the fluid intake 114 may be threadingly connected to a housing 156 of the centrifugal pump assembly 116. Alternatively, in an embodiment the fluid intake 114 comprises a flange with bolt holes that bolt to a base with bolt holes at a downhole end of the centrifugal pump assembly 116. A drive shaft 144 of the seal section 112 may be coupled to a drive shaft of the electric motor 110 and receive rotational power from the drive shaft of the electric motor 110. An uphole end of the drive shaft 144 may be coupled via a coupling shell 148 to a downhole end of a drive shaft 146 of the centrifugal pump assembly 116, and the drive shaft 146 of the centrifugal pump assembly 116 may receive rotational power from the electric motor 110 via the drive shaft 144 of the seal section 112.

In an embodiment, the centrifugal pump assembly 116 comprises one or more centrifugal pump stages 150, where each pump stage 150 comprises an impeller 152 that is mechanically coupled to the drive shaft 146 of the centrifugal pump assembly 116 and a corresponding diffuser 154 that is stationary and retained by the housing 156 of the centrifugal pump assembly 116. In an embodiment, the impellers 152 comprise a plurality of impeller vanes attached at one side to an impeller hub 153 and at an opposite side to an impeller shroud 151 and the diffusers 154 comprise a plurality of diffuser vanes attached at one side to a diffuser hub 157 and an opposite side to a diffuser shroud 155, as described further with reference to FIG. 3A, FIG. 4A, FIG. 5A, FIG. 5B, and FIG. 5C below. The led line for label 152 referring to the impeller 152 indicates a flow passage of the impeller 152 that is defined between the impeller shroud 151, the impeller hub 153, and the impeller vanes. The led line for label 154 referring to the diffuser 154 indicates a flow passage of the diffuser 154 that is defined between the diffuser shroud 155, the diffuser hub 157, and the diffuser vanes. In some contexts, the impeller shroud 151 may be referred to as an impeller shroud structure, the impeller hub 153 may be referred to as an impeller hub structure, the diffuser shroud 155 may be referred to as a diffuser shroud structure, and the diffuser hub 157 may be referred to as a diffuser hub structure.

In an embodiment, the number of impeller vanes in an impeller 152 is equal to the number of diffuser vanes in the diffuser 154 associated with that impeller 152. In an embodiment, the number of impeller vanes in an impeller 152 is different from the number of diffuser vanes in the diffuser 154 associated with that impeller 152. In some circumstances, it is desirable that the number of impeller vanes be different than the number of diffuser vanes so that at any one time only a single impeller vane is passing and/or aligned with any diffuser vane at the same time, whereby to avoid undesirable energy pulses or vibration harmonics.

In an embodiment, the impellers 152 comprise a first plurality of impeller vanes, and the diffusers 154 comprise a second plurality of diffuser vanes. In an embodiment, the number of the first plurality of impeller vanes is different from the number of the second plurality of diffuser vanes. In an embodiment, the number of impeller vanes is greater than the number of diffuser vanes. In an embodiment, the number of impeller vanes is less than the number of diffuser vanes. In an embodiment, the impellers 152 comprise 3 impeller vanes and the diffusers 154 comprise 4 diffuser vanes. In an embodiment, the impellers 152 comprise 4 impeller vanes and the diffusers 154 comprise 5 diffuser vanes. In an embodiment, the impellers 152 comprise 5 impeller vanes and the diffusers 154 comprise 6 diffuser vanes. In an embodiment, the impellers 152 comprise 6 impeller vanes and the diffusers 154 comprise 7 diffuser vanes. In an embodiment, the impellers 152 comprise 7 impeller vanes and the diffusers 154 comprise 8 diffuser vanes. In an embodiment, the impellers 152 comprise 8 impeller vanes and the diffusers 154 comprise 9 diffuser vanes. In an embodiment, the impellers 152 comprise 9 impeller vanes and the diffusers 154 comprise 10 diffuser vanes.

In an embodiment, the impellers 152 comprise 3 impeller vanes and the diffusers 154 comprise 5 diffuser vanes. In an embodiment, the impellers 152 comprise 4 impeller vanes and the diffusers 154 comprise 6 diffuser vanes. In an embodiment, the impellers 152 comprise 5 impeller vanes and the diffusers 154 comprise 7 diffuser vanes. In an embodiment, the impellers 152 comprise 6 impeller vanes and the diffusers 154 comprise 8 diffuser vanes. In an embodiment, the impellers 152 comprise 7 impeller vanes and the diffusers 154 comprise 9 diffuser vanes. In an embodiment, the impellers 152 comprise 8 impeller vanes and the diffusers 154 comprise 10 diffuser vanes. In an embodiment, the impellers 152 comprise 9 impeller vanes and the diffusers 154 comprise 11 diffuser vanes.

In an embodiment, the impellers 152 comprise 4 impeller vanes and the diffusers 154 comprise 3 diffuser vanes. In an embodiment, the impellers 152 comprise 5 impeller vanes and the diffusers 154 comprise 4 diffuser vanes. In an embodiment, the impellers 152 comprise 6 impeller vanes and the diffusers 154 comprise 5 diffuser vanes. In an embodiment, the impellers 152 comprise 7 impeller vanes and the diffusers 154 comprise 6 diffuser vanes. In an embodiment, the impellers 152 comprise 8 impeller vanes and the diffusers 154 comprise 7 diffuser vanes. In an embodiment, the impellers 152 comprise 9 impeller vanes and the diffusers 154 comprise 8 diffuser vanes. In an embodiment, the impellers 152 comprise 10 impeller vanes and the diffusers 154 comprise 9 diffuser vanes.

In an embodiment, the impellers 152 comprise 5 impeller vanes and the diffusers 154 comprise 3 diffuser vanes. In an embodiment, the impellers 152 comprise 6 impeller vanes and the diffusers 154 comprise 4 diffuser vanes. In an embodiment, the impellers 152 comprise 7 impeller vanes and the diffusers 154 comprise 5 diffuser vanes. In an embodiment, the impellers 152 comprise 8 impeller vanes and the diffusers 154 comprise 6 diffuser vanes. In an embodiment, the impellers 152 comprise 9 impeller vanes and the diffusers 154 comprise 7 diffuser vanes. In an embodiment, the impellers 152 comprise 10 impeller vanes and the diffusers 154 comprise 8 diffuser vanes. In an embodiment, the impellers 152 comprise 11 impeller vanes and the diffusers 154 comprise 9 diffuser vanes.

The impellers 152 coupled to the drive shaft 146 rotate as the electric motor 110 provides rotational power to the drive shaft 146. The turning impeller 152 of each pump stage 150 does work on the well fluid 142 and increases the kinetic energy of the well fluid 142 it receives from the outlet of the downhole diffuser 154. The diffuser 154 at each pump stage changes the direction of the well fluid 142 received from the downhole impeller 152 and converts at least some of the kinetic energy of the well fluid 142 into pressure energy. Thus, as the well fluid 142 flows through the multiple pump stages 150 the pressure of the well fluid 142 is increased.

In an embodiment, the impellers 152 may comprise a keyway that mates with a corresponding keyway on the drive shaft 146 of the centrifugal pump assembly 116 and a key may be installed into the two keyways, wherein the impeller 152 may be mechanically coupled to the drive shaft 146 of the centrifugal pump assembly 116. In an embodiment, the centrifugal pump assembly 116 may comprise two pump stages 150, three pump stages 150, or four pump stages 150. In an embodiment the centrifugal pump assembly 116 comprises at least five pump stages 150, at least ten pump stages 150, at least twenty pump stages 150, at least thirty pump stages 150, at least forty pump stages 150, at least fifty pump stages 150, at least seventy pump stages 150, at least one hundred pump stages 150, at least one hundred and fifty pump stages 150, at least two hundred pump stages 150, at least two hundred and fifty pump stages 150, at least three hundred pump stages 150, at least three hundred and fifty pump stages 150, at least four hundred pump stages 150, at least four hundred and fifty pump stages 150, or at least five hundred pump stages 150, but fewer than two thousand pump stages.

Figure 3A:
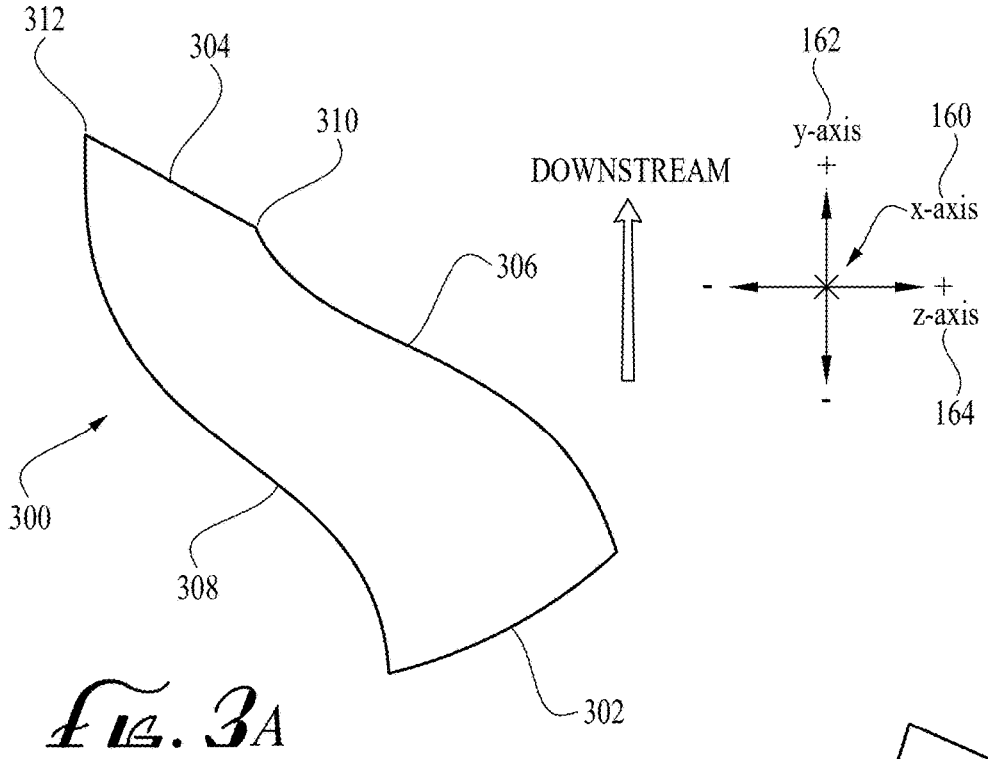
FIG. 3A is an illustration of an impeller vane of a centrifugal pump stage according to an embodiment of the disclosure.

Turning now to FIG. 3A, an impeller vane 300 is described. In an embodiment, the impellers 152 described above with reference to FIG. 2 comprise impeller vanes that are like or the same as the impeller vane 300. The impeller vane 300 comprises a leading edge 302, a trailing edge 304, a hub edge 306, and a shroud edge 308. The leading edge 302 is located at a downhole end of the impeller vane 300 and receives fluid flow (e.g., receives fluid flow from the fluid intake 114, from a gas separator liquid phase discharge port, or from a centrifugal pump stage 150 downhole of the impeller vane 300). The impeller vane 300 attaches to a hub structure of the impeller 152 at the hub edge 306 and attaches to a shroud structure of the impeller 154 at the shroud edge 308. The hub structure of the impeller 152 is located between the impeller vane 300 and a central axis of the impeller 152. The shroud structure of the impeller 152 is located between the impeller vane 300 and the housing 156 of the centrifugal pump assembly 116 (e.g., at an outside edge of the impeller 152).

The trailing edge 304 of the impeller vane 300 attaches to the hub structure of the impeller 152 at a first point 310 and attaches to the shroud structure of the impeller 152 at a second point 312. The second point 312 is located further downstream than the first point 310. The portion of the trailing edge 304 of the impeller vane 300 that is located downstream of the first point 310 constitutes an extension of the outer portion of the trailing edge 304 of the impeller vane 300 relative to conventional impeller vanes. This extension increases progressively from a minimum extension at the first point 310 of the trailing edge 304 to a maximum extension at the second point 312 of the trailing edge 304. The extended portion of the impeller vane 300 allows the impeller vane 300 taught by the present disclosure to perform more work on the fluid 142 than a conventional impeller of a centrifugal pump stage of the same diameter and height of the novel centrifugal pump stage 150 taught herein having impeller 152 that comprises the impeller vane 304. This permits the centrifugal pump stage 150 to generate more pressure or more head than a comparably sized conventional centrifugal pump stage.

Figure 3B:
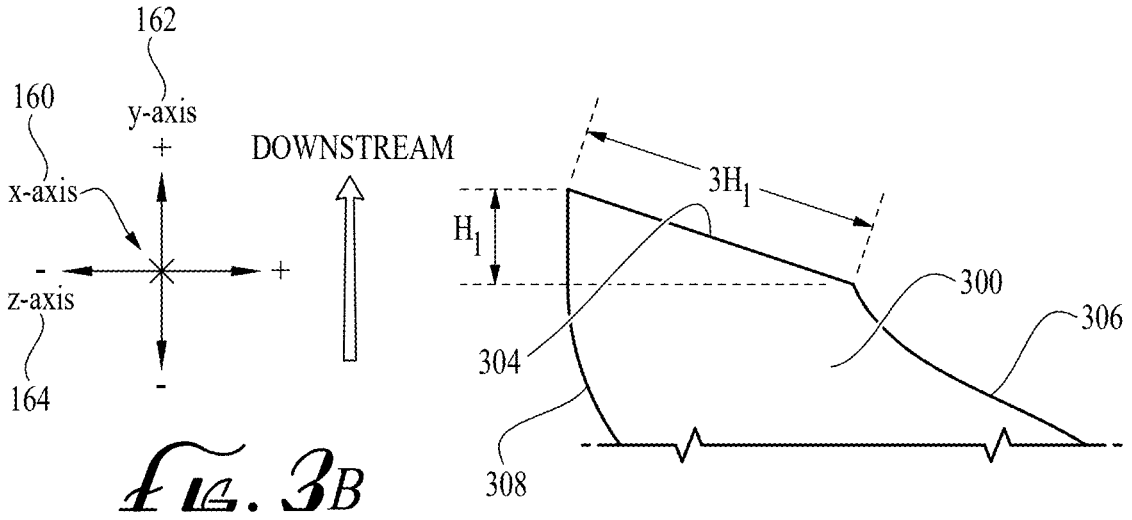
FIG. 3B, FIG. 3C, and FIG. 3D illustrate different configurations of a trailing edge of an impeller vane of a centrifugal pump stage according to an embodiment of the disclosure.
Figure 3C:
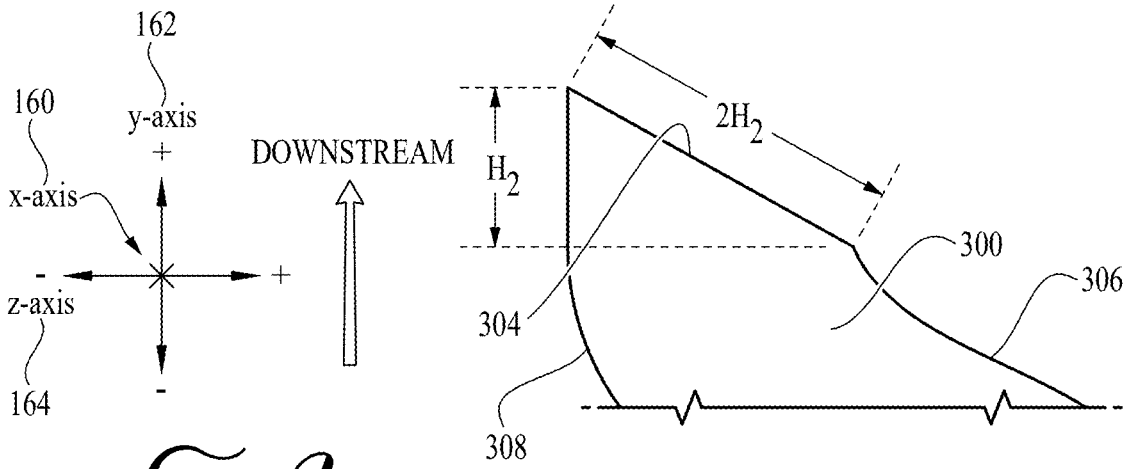
Figure 3D:
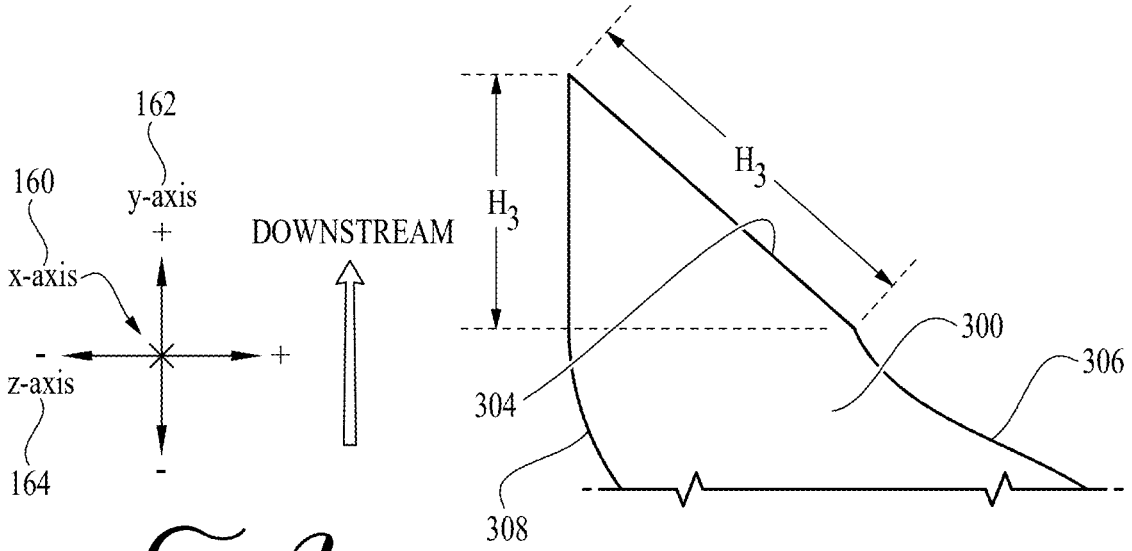

Turning now to FIG. 3B, FIG. 3C, and FIG. 3D, different configurations of the trailing edge 304 of the impeller vane 300 are described. In FIG. 3B, the outside (e.g., further away from the centerline of the impeller 152 at the point 312) of the trailing edge 304 is a distance $H_1$ downstream of the inside (e.g., closer to the centerline of the impeller 152 at point 310) of the trailing edge 304. The width of the trailing edge 304 is 3 times the distance $H_1$. In FIG. 3C, the outside (point 312) of the trailing edge 304 is a distance $H_2$ downstream of the inside (point 310) of the trailing edge 304, and the width of the trailing edge 304 is 2 times the distance $H_2$. In FIG. 3D, the outside (point 312) of the trailing edge 304 is a distance $H_3$ downstream of the inside (point 310) of the trailing edge 304, and the width of the trailing edge 304 is also $H_3$. It will be appreciated that the present disclosure contemplates other amounts of extension of the outside edge of the trailing edge 304 of the impeller vane 300 versus the inside edge of the trailing edge 304. For example, the extension may be 15% of the width of the trailing edge 304, 20% of the width of the trailing edge 304, 25% of the width of the trailing edge 304, 30% of the width of the trailing edge 304, 35% of the width of the trailing edge 304, 40% of the width of the trailing edge 304, 45% of the width of the trailing edge 304, 50% of the width of the trailing edge 304, 55% of the width of the trailing edge 304, 60% of the width of the trailing edge 304, 65% of the width of the trailing edge 304, 70% of the width of the trailing edge 304, 75% of the width of the trailing edge 304, 80% of the width of the trailing edge 304, 85% of the width of the trailing edge 304, 90% of the width of the trailing edge 304, or 95% of the width of the trailing edge 304. It will be appreciated that in an embodiment, the extension of the outside of the trailing edge 304 may extend downstream of the inside of the trailing edge 304 by a percentage of the width of the trailing edge 304 between the values recited above. For example, the extension of the outside of the trailing edge 304 downstream of the inside of the trailing edge 304 illustrated in FIG. 3B is 33.3%, a value intermediate between 30% and 35%. In an embodiment, the extension may be 15% of the width of the trailing edge 304, each impeller vane trailing edge attaches to the shroud of the impeller at a location about ⅓ of the length of the impeller vane trailing edge further downstream of the location where the impeller vane trailing edge attaches to the hub of the impeller. In an embodiment, each impeller vane trailing edge attaches to the shroud of the impeller at a location about ½ of the length of the impeller vane trailing edge further downstream of the location where the impeller vane trailing edge attaches to the hub of the impeller. In an embodiment, each impeller vane trailing edge attaches to the shroud of the impeller at a location about ⅔ of the length of the impeller vane trailing edge further downstream of the location where the impeller vane trailing edge attaches to the hub of the impeller. In an embodiment, each impeller vane trailing edge attaches to the shroud of the impeller at a location from about ¼ of the length to about ¾ of the length of the impeller vane trailing edge further downstream of the location where the impeller vane trailing edge attaches to the hub of the impeller. A desired amount of extension of the outside of the trailing edge 304 downstream of the inside of the trailing edge 304 can be determined by one skilled in the art by using computational fluid dynamics (CFD) modeling techniques and/or by testing alternative configurations.

Figure 4A:
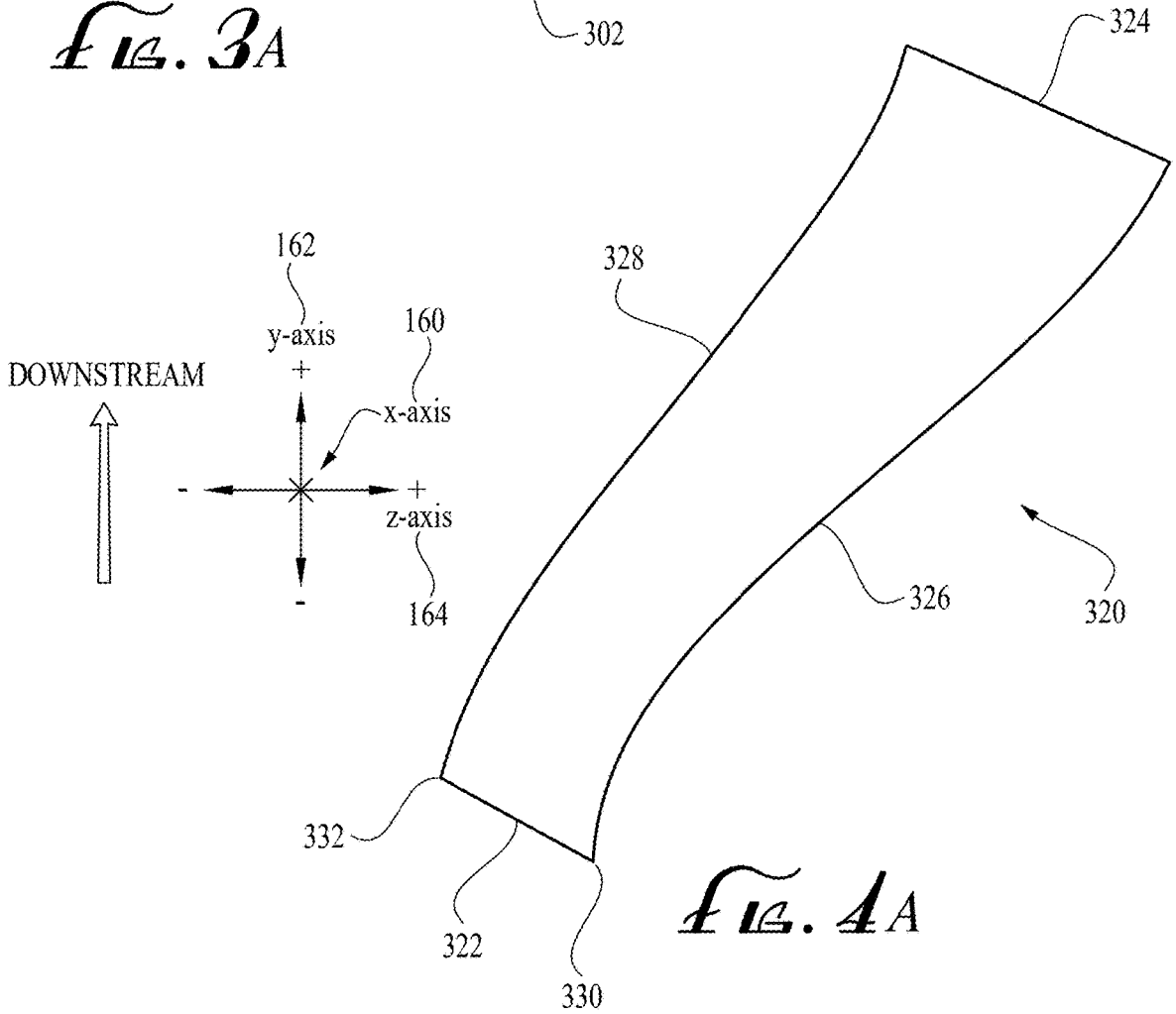
FIG. 4A is an illustration of a diffuser vane of a centrifugal pump stage according to an embodiment of the disclosure.

Turning now to FIG. 4A, a diffuser vane 320 is described. In an embodiment, the diffusers 154 described above with reference to FIG. 2 comprise diffuser vanes that are like or the same as the diffuser vane 320. The diffuser vane 320 comprises a leading edge 322, a trailing edge 324, a hub edge 326, and a shroud edge 328. The leading edge 322 is located at a downhole end of the diffuser vane 320 and receives fluid flow from the impeller 152 of the centrifugal pump stage. The diffuser vane 320 attaches to a hub structure of the diffuser 154 at the hub edge 326 and attaches to a shroud structure of the diffuser 154 at the shroud edge 328. The hub structure of the diffuser 154 is located between the diffuser vane 320 and a central axis of the diffuser 154. The shroud structure of the diffuser 154 is located between the diffuser vane 320 and the housing 156 of the centrifugal pump assembly 116 (e.g., an outside edge of the diffuser).

The leading edge 322 of the diffuser vane 320 attaches to the hub structure of the diffuser 154 at a third point 330 and attaches to the shroud structure of the diffuser 154 at a fourth point 332. The fourth point 332 is located further downstream than the third point 330. The extension in the leading edge 322 of the diffuser 154 may be said to be provided by an extension of the inner portion of the leading edge 322. This extension increases progressively from a minimum extension at the fourth point 332 of the leading edge 322 to a maximum extension at the third point 330 of the leading edge 322. The inner extension of the leading edge 322 of the diffuser vane 320 substantially complements and matches the outer extension of the trailing edge 304 of the impeller vane 300 described above with reference to FIG. 3A, FIG. 3B, FIG. 3C, and FIG. 3D.

Figure 4B:
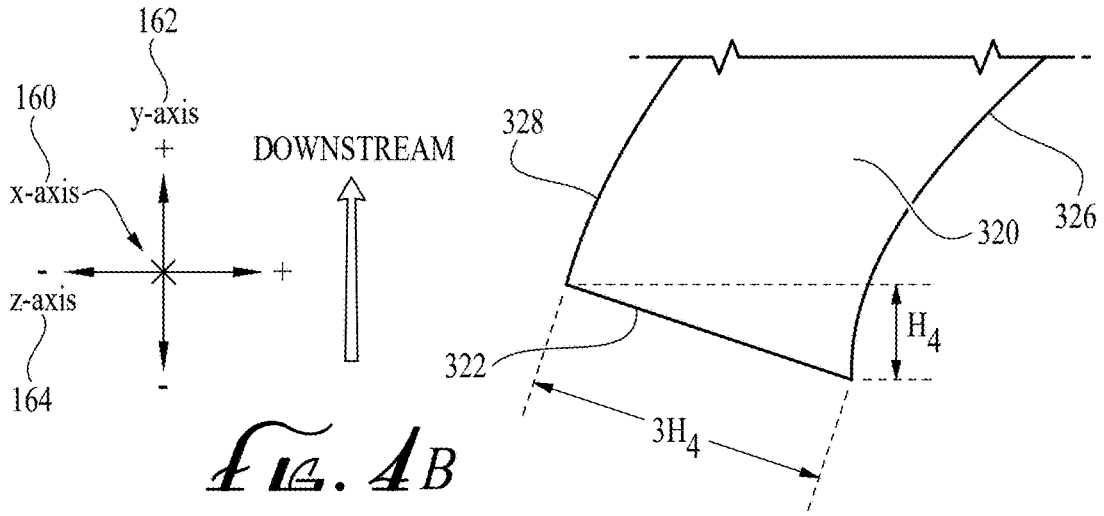
FIG. 4B, FIG. 4C, and FIG. 4D illustrate different configurations of a leading edge of a diffuser vane of a centrifugal pump stage according to an embodiment of the disclosure.
Figure 4C:
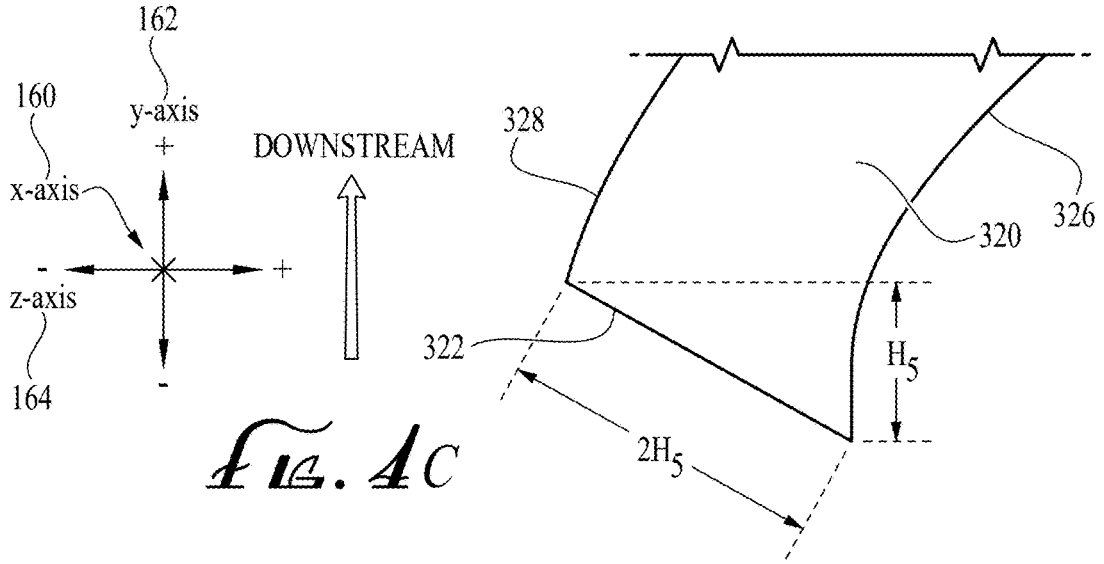
Figure 4D:
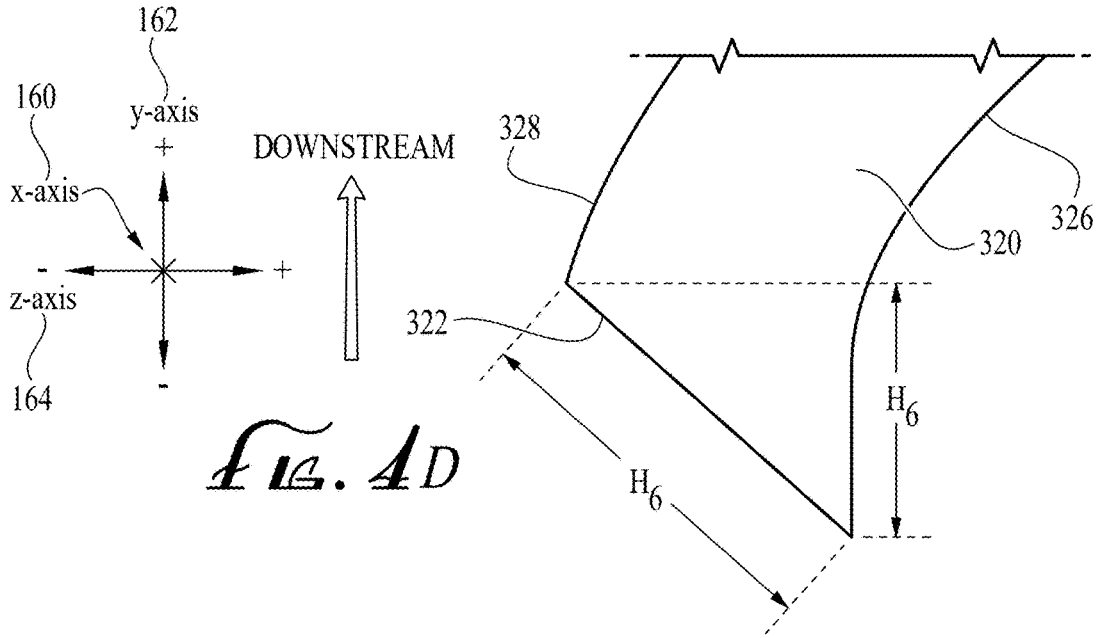

Turning now to FIG. 4B, FIG. 4C, and FIG. 4D, different configurations of the leading edge 322 of the diffuser vane 320 are described. In FIG. 4B, the outside (e.g., further away from the centerline of the diffuser 154 at the point 332) of the leading edge 322 is a distance $H_4$ downstream of the inside (e.g., closer to the centerline of the diffuser 154 at point 330) of the leading edge 322. The width of the leading edge 322 is 3 times the distance $H_4$. In FIG. 4C, the outside (point 332) of the leading edge 322 is a distance $H_5$ downstream of the inside (point 330) of the leading edge 322, and the width of the leading edge 322 is 2 times the distance $H_5$. In FIG. 4D, the outside (point 332) of the leading edge 322 is a distance He downstream of the inside (point 330) of the leading edge 322, and the width of the leading edge 322 is also $H_6$. It will be appreciated that the present disclosure contemplates other amounts of extension of the inside edge of the leading edge 322 of the diffuser vane 320 versus the inside edge of the leading edge 322. For example, the extension may be 15% of the width of the leading edge 322, 20% of the width of the leading edge 322, 25% of the width of the leading edge 322, 30% of the width of the leading edge 322, 35% of the width of the leading edge 322, 40% of the width of the leading edge 322, 45% of the width of the leading edge 322, 50% of the width of the leading edge 322, 55% of the width of the leading edge 322, 60% of the width of the leading edge 322, 65% of the width of the leading edge 322, 70% of the width of the leading edge 322, 75% of the width of the leading edge 322, 80% of the width of the leading edge 322, 85% of the width of the leading edge 322, 90% of the width of the leading edge 322, or 95% of the width of the leading edge 322. It will be appreciated that in an embodiment, the extension of the outside of the leading edge 322 may extend downstream of the inside of the leading edge 322 by a percentage of the width of the leading edge 322 between the values recited above. For example, the extension of the outside of the leading edge 322 downstream of the inside of the leading edge 322 illustrated in FIG. 4B is 33.3%, a value intermediate between 30% and 35%. A desired amount of extension of the outside of the leading edge 322 downstream of the inside of the leading edge 322 can be determined by one skilled in the art by using computational fluid dynamics (CFD) modeling techniques and/or by testing alternative configurations.

Figure 5A:
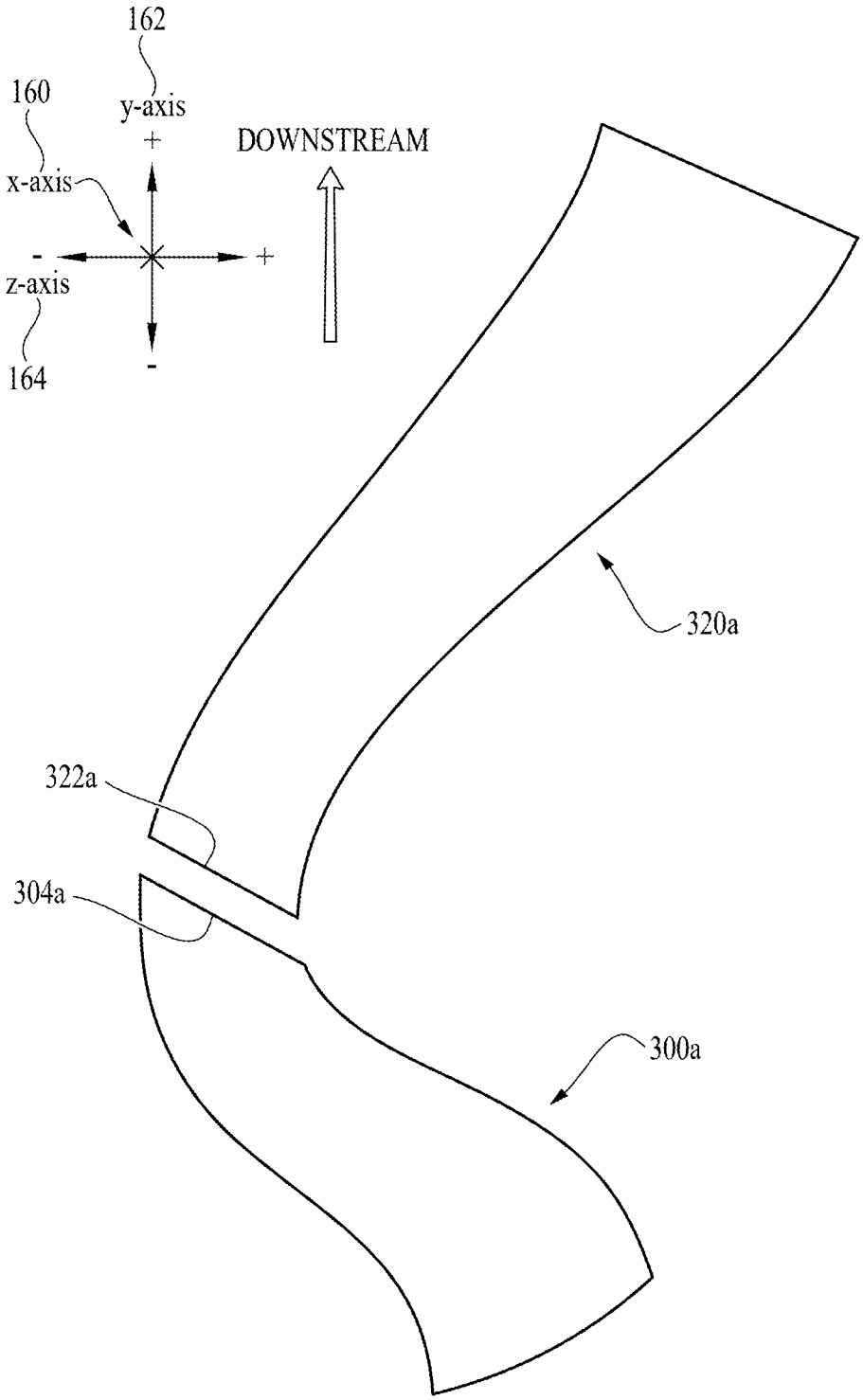
FIG. 5A, FIG. 5B, and FIG. 5C are illustrations of the positional relationship between impeller vanes and diffuser vanes of a centrifugal pump stage according to an embodiment of the disclosure.

Turning now to FIG. 5A, the impeller vane 300*a* is illustrated such as to show how it aligns with the diffuser vane 320*a*. It is understood that a gap may be provided between the trailing edge 304*a* of the impeller vane 300*a* and the leading edge 322*a* of the diffuser 320*a* to allow for a limited amount of axial motion of the impeller 152 during different modes of operation of the centrifugal pump assembly 116. The impeller 152 having impeller vanes 300*a* and the diffuser 154 having diffuser vanes 320*a* may be made out of metal according to any suitable manufacturing process. The impeller 152 with impeller vanes 300*a* and the diffuser 154 with diffuser vanes 320*a* may be manufactured using a metal casting process. The impeller 152 with impeller vanes 300*a* and the diffuser 154 with diffuser vanes 320*a* may be manufactured using a 3-D printing process. The impeller 152 with impeller vanes 300*a* and the diffuser 154 with diffuser vanes 320*a* may be manufactured using a different process. As illustrated in FIG. 5A, the trailing edge 304*a* of the impeller vane 300*a* is straight (e.g., the trailing edge 304*a* between the endpoints 310, 312 illustrated in FIG. 3A follows a straight path), and the leading edge 322*a* of the diffuser vane 320*a* is straight (e.g., the leading edge 322*a* between the endpoints 330, 332 illustrated in FIG. 4A follows a straight path). In other embodiments, the trailing edge 304 of the impeller vane 300 and the leading edge 322 of the diffuser vane 320 may be curved rather than straight.

Figure 5B:
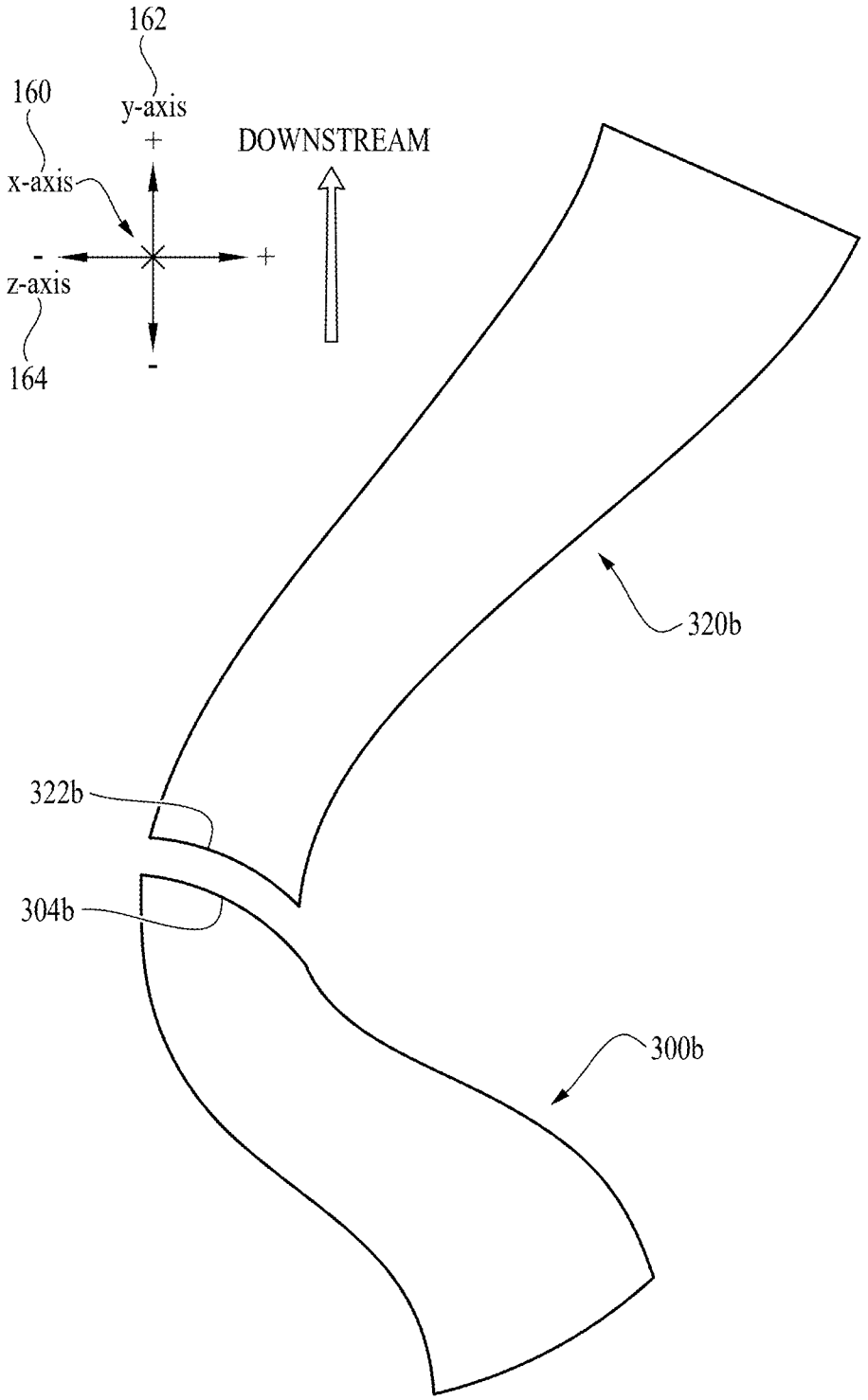
Figure 5C:
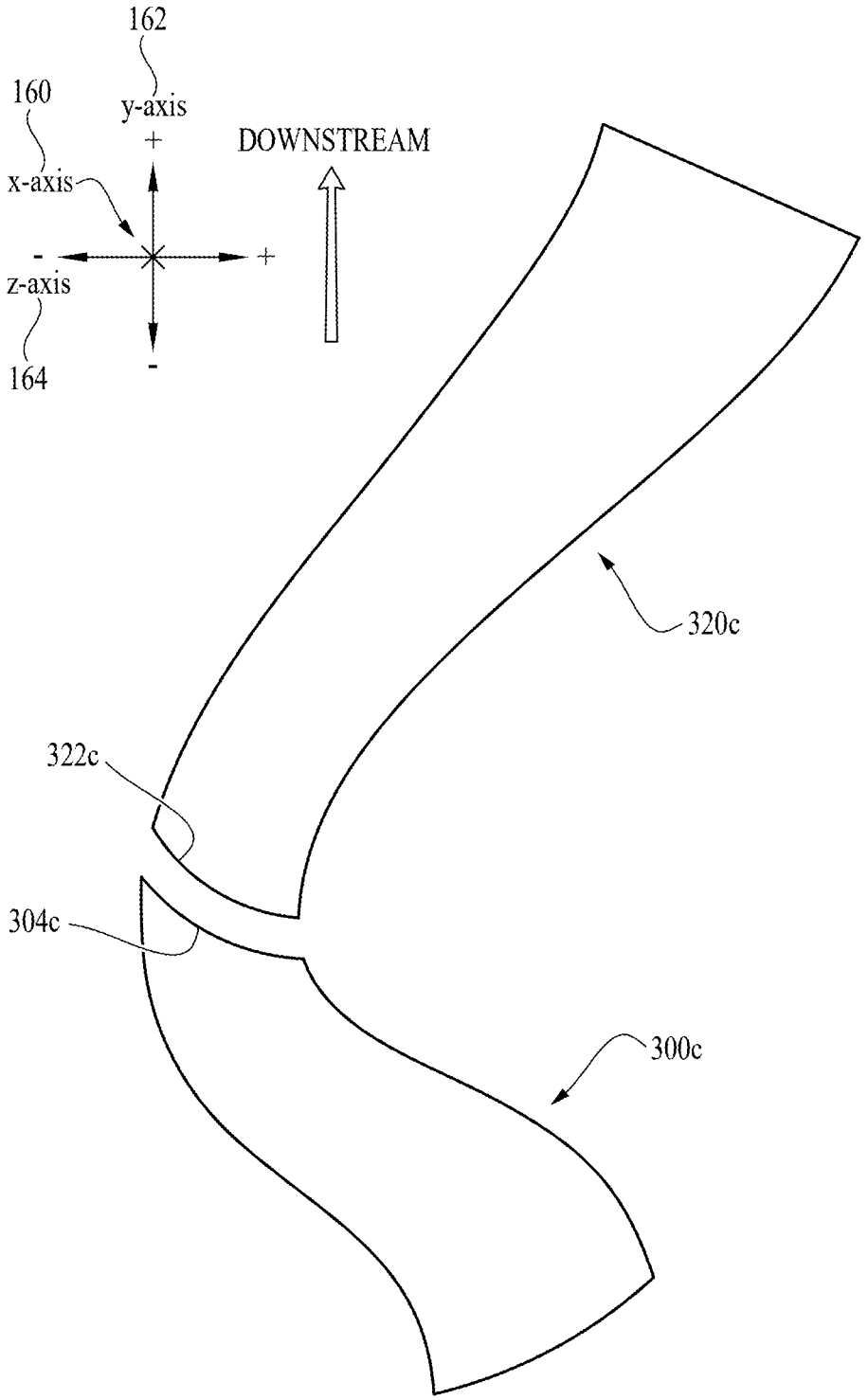
Figure 9:
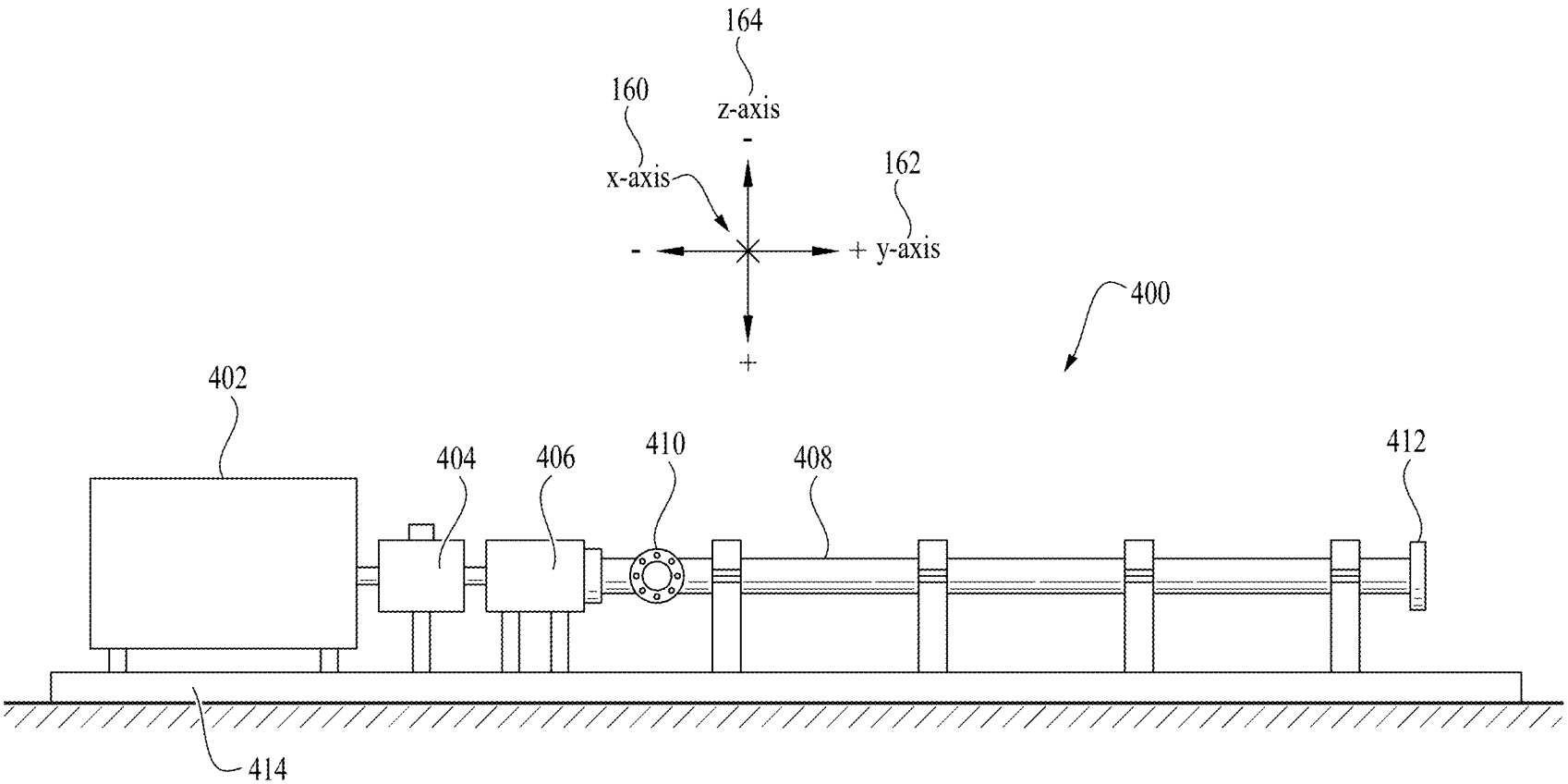

Turning now to FIG. 5B, the impeller vane 300*b* is substantially similar to the impeller vane 300*a* except that the trailing edge 304*b* is curved convex (e.g., the trailing edge 304*b* between the endpoints 310, 312 illustrated in FIG. 3A follows a curved convex path), while the trailing edge 304*a* is straight. The diffuser vane 320*b* is substantially similar to the diffuser vane 320*a* except that the leading edge 322*b* is curved concave (e.g., the leading edge 322*b* between the endpoints 330, 332 illustrated in FIG. 4A follows a curved concave path), while the trailing edge 322*a* is straight. Turning now to FIG. 5C, the impeller vane 300*c* is substantially similar to the impeller vane 300*a* except that the trailing edge 304*c* is curved concave (e.g., the trailing edge 304*c* between the endpoints 310, 312 illustrated in FIG. 3A follows a curved concave path), while the trailing edge 304*a* is straight. The diffuser vane 320*c* is substantially similar to the diffuser vane 320*a* except that the leading edge 322*c* is curved convex (e.g., the leading edge 322*c* between the endpoints 330, 332 illustrated in FIG. 4A follows a curved convex path), while the trailing edge 322*a* is straight. In an embodiment, the tailing edge 304 of the impeller vanes 300 may have follow a differently shaped path between the end points 310, 312 illustrated in FIG. 3A such as a parabolic path, a sinusoidal path, or a zig-zag path. In an embodiment, the leading edge 322 of the diffuser vanes 320 may have follow a differently shaped path between the end points 330, 332 illustrated in FIG. 4A such as a parabolic path, a sinusoidal path, or a zig-zag path. In an embodiment, the shape of the leading edge 322 of the diffuser vanes 320 may be a mirror image of the shape of the trailing edge 304 of the impeller vanes 300.

In an embodiment, the number of impeller vanes 300*a* in each impeller 152 is different from the number of diffuser vanes 320*a* in each diffuser 154. In an embodiment, the number of impeller vanes 300*a* in each impeller 152 is less than the number of diffuser vanes 320*a* in each diffuser 154. In an embodiment, each diffuser vane leading edge 322*a* attaches to the shroud of the diffuser 154 at a distance downstream of where the diffuser vane leading edge 322*a* attaches to the hub of the diffuser 154 that is about a same distance as a distance downstream that each impeller vane trailing edge 304*a* attaches to the shroud of the impeller 152 versus where the impeller vane trailing edge 304*a* attaches to the hub of the impeller 152.

Turning now to FIG. 6, a horizontal pump system (HPS) 400 is described. In an embodiment, the horizontal pump system 400 comprises a motor 402, a rotational coupling 404, a mechanical seal 406, and a centrifugal pump assembly 408. In an embodiment, a fluid inlet 410 is integrated into a first end of the centrifugal pump assembly 408 and a fluid outlet 412 may be integrated into a second end of the centrifugal pump assembly 408. The motor 402, the rotational coupling 404, the mechanical seal 406, and the centrifugal pump assembly 408 may be mounted on a skid 414 such that it can be easily transported to a location on a truck and placed on the ground at the location. The centrifugal pump assembly 408 is substantially similar to the centrifugal pump assembly 116 described above with reference to FIG. 2, FIG. 3A, FIG. 3B, FIG. 3C, FIG. 3D, FIG. 4A, FIG. 4B, FIG. 4C, FIG. 4D, FIG. 5A, FIG. 5B, and FIG. 5C. For example, the centrifugal pump assembly 408 comprises a plurality of pump stages 150 with an impeller 152 and a diffuser 154 as described above with reference to FIG. 3A, FIG. 3B, FIG. 3C, FIG. 3D, FIG. 4A, FIG. 4B, FIG. 4C, FIG. 4D, FIG. 5A, FIG. 5B, and FIG. 5C, where each pump stage 150 comprises the impeller 152 coupled to the drive shaft 146 of the centrifugal pump assembly 408 and the diffuser 154 that is retained by a housing of the centrifugal pump assembly 408. Specifically, the impeller of each stage of the centrifugal pump assembly 408 comprises a first plurality of vanes 300 as illustrated in and described with reference to FIG. 3A, FIG. 3B, FIG. 3C, FIG. 3D, FIG. 5A, FIG. 5B, and FIG. 5C, and the diffuser of each stage of the centrifugal pump assembly 408 comprises a second plurality of vanes 320 as illustrated in and described with reference to FIG. 4A, FIG. 4B, FIG. 4C, FIG. 4D, FIG. 5A, FIG. 5B, and FIG. 5C.

The motor 402 may be an electric motor, a hydraulic turbine, or an air turbine. When the motor 402 turns, the drive shaft of the centrifugal pump assembly 408 turns, turning the impellers of the centrifugal pump assembly 408. The torque provided by the motor 402 is transferred via the rotational coupling 404 to the drive shaft of the centrifugal pump assembly 408.

The HPS 400 may be applied for use in a variety of different surface operations. The HSP 400 can be used as a crude oil pipeline pressure and/or flow booster. The HPS 400 can be used in a mine dewatering operation (e.g., removing water from a mine). The HPS 400 can be used in geothermal energy applications, for example to pump geothermal water from a wellhead through a pipe to an end-use or energy conversion facility. The HPS 400 can be used in carbon sequestration operations. The HPS 400 can be used in salt water disposal operations, for example receiving salt water from a wellbore and pumping the salt water under pressure down into a disposal well. The HPS 400 can be used in desalinization operations. In any of these surface pumping applications, the novel impeller vane structure and the novel diffuser vane structure diffuser structures taught above can advantageously be applied to increase the pressure output of the centrifugal pump assembly 408, to increase the head and/or flow rate produced by the centrifugal pump assembly 408, and/or increase the service life of the centrifugal pump assembly.

Figure 7:
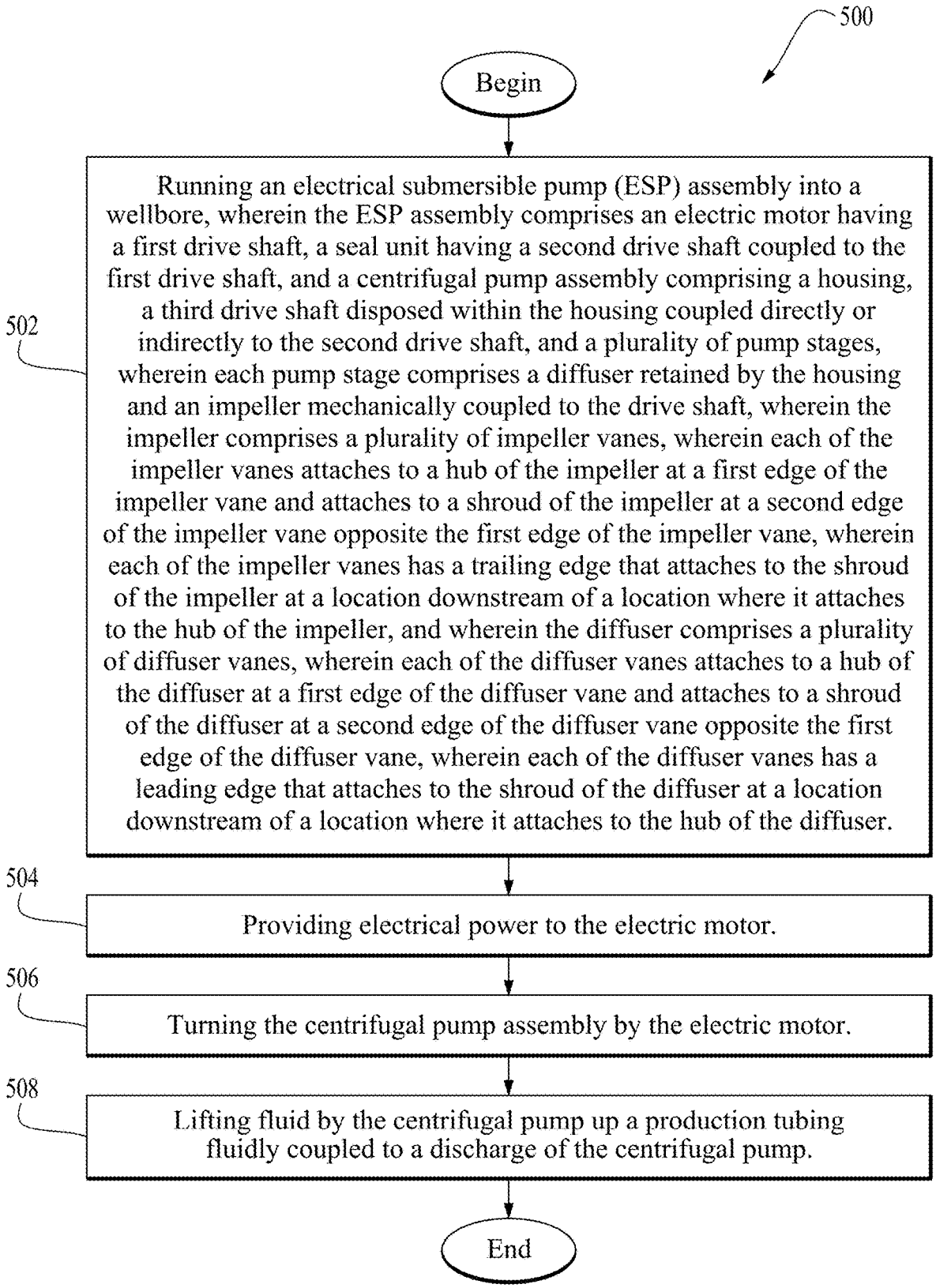
FIG. 7 is a flow chart of a method according to an embodiment of the disclosure.

Turning now to FIG. 7, a method 500 is described. In an embodiment, the method 500 is a method of lifting fluid in a wellbore. At block 502, the method 500 comprises running an electrical submersible pump (ESP) assembly into a wellbore. The ESP assembly comprises an electric motor having a first drive shaft, a seal unit having a second drive shaft coupled to the first drive shaft, and a centrifugal pump assembly. The centrifugal pump assembly comprises a housing, a third drive shaft disposed within the housing coupled directly or indirectly to the second drive shaft, and a plurality of pump stages. Each pump stage comprises a diffuser retained by the housing and an impeller mechanically coupled to the drive shaft, wherein the impeller comprises a plurality of impeller vanes, wherein each of the impeller vanes attaches to a hub of the impeller at a first edge of the impeller vane and attaches to a shroud of the impeller at a second edge of the impeller vane opposite the first edge of the impeller vane, wherein each of the impeller vanes has a trailing edge that attaches to the shroud of the impeller at a location downstream of a location where it attaches to the hub of the impeller, and wherein the diffuser comprises a plurality of diffuser vanes, wherein each of the diffuser vanes attaches to a hub of the diffuser at a first edge of the diffuser vane and attaches to a shroud of the diffuser at a second edge of the diffuser vane opposite the first edge of the diffuser vane, wherein each of the diffuser vanes has a leading edge that attaches to the shroud of the diffuser at a location downstream of a location where it attaches to the hub of the diffuser.

In an embodiment, each impeller vane trailing edge attaches to the shroud of the impeller at a location about ⅓ of the length of the impeller vane trailing edge further downstream of the location where the impeller vane trailing edge attaches to the hub of the impeller. In an embodiment, each impeller vane trailing edge attaches to the shroud of the impeller at a location about ½ of the length of the impeller vane trailing edge further downstream of the location where the impeller vane trailing edge attaches to the hub of the impeller. In an embodiment, each impeller vane trailing edge attaches to the shroud of the impeller at a location about ⅔ of the length of the impeller vane trailing edge further downstream of the location where the impeller vane trailing edge attaches to the hub of the impeller. In an embodiment, each impeller vane trailing edge attaches to the shroud of the impeller at a location from about ¼ of the length to about ¾ of the length of the impeller vane trailing edge further downstream of the location where the impeller vane trailing edge attaches to the hub of the impeller. In an embodiment, the number of impeller vanes of each impeller is different than the number of diffuser vanes of each diffuser. In an embodiment, the number of impeller vanes of each impeller is less than the number of diffuser vanes of each diffuser.

At block 504, the method 500 comprises providing electrical power to the electric motor. At block 506, the method 500 comprises turning the centrifugal pump assembly by the electric motor. At block 508, the method 500 comprises lifting fluid by the centrifugal pump up a production tubing fluidly coupled to a discharge of the centrifugal pump. In an embodiment, the impeller vanes of the impellers of the centrifugal pump stages provide a higher work output in the centrifugal pump lifting fluid up the production tubing than an equally sized centrifugal pump assembly using conventional pump stages.

Additional Embodiments

The following are non-limiting, specific embodiments in accordance with the present disclosure:

A first embodiment, which is an electric submersible pump (ESP) assembly comprising an electric motor having a first drive shaft; a seal unit having a second drive shaft coupled to the first drive shaft; and a centrifugal pump assembly comprising a housing, a third drive shaft disposed within the housing coupled directly or indirectly to the second drive shaft, and a plurality of pump stages, wherein each pump stage comprises a diffuser retained by the housing and an impeller mechanically coupled to the drive shaft, wherein the impeller comprises a plurality of impeller vanes, wherein each impeller vane attaches to a hub of the impeller at a first edge of the impeller vane and attaches to a shroud of the impeller at a second edge of the impeller vane opposite the first edge of the impeller vane, wherein each impeller vane has an impeller vane trailing edge that attaches to the shroud of the impeller at a location downstream of a location where the impeller vane trailing edge attaches to the hub of the impeller, and wherein the diffuser comprises a plurality of diffuser vanes, wherein each diffuser vane attaches to a hub of the diffuser at a first edge of the diffuser vane and attaches to a shroud of the diffuser at a second edge of the diffuser vane opposite the first edge of the diffuser vane, wherein each diffuser vane has a diffuser vane leading edge that attaches to the shroud of the diffuser at a location downstream of a location where the diffuser vane leading edge attaches to the hub of the diffuser.

A second embodiment, which is the ESP assembly of the first embodiment, wherein the number of impeller vanes of each impeller is different than the number of diffuser vanes of each diffuser.

A third embodiment, which is the ESP assembly of the first embodiment, wherein the number of impeller vanes of each impeller is less than the number of diffuser vanes of each diffuser.

A fourth embodiment, which is the ESP assembly of the first embodiment, wherein the number of impeller vanes of each impeller is greater than the number of diffuser vanes of each diffuser.

A fifth embodiment, which is the ESP assembly of the first embodiment, wherein the number of impeller vanes of each impeller is equal to the number of diffuser vanes of each diffuser.

A sixth embodiment, which is the ESP assembly of any of the first through the fifth embodiment, wherein each impeller vane trailing edge attaches to the shroud of the impeller at a location about ⅓ of the length of the impeller vane trailing edge further downstream of the location where the impeller vane trailing edge attaches to the hub of the impeller.

A seventh embodiment, which is the ESP assembly of any of the first through the fifth embodiment, wherein each impeller vane trailing edge attaches to the shroud of the impeller at a location about ½ of the length of the impeller vane trailing edge further downstream of the location where the impeller vane trailing edge attaches to the hub of the impeller.

An eighth embodiment, which is the ESP assembly of any of the first through the fifth embodiment, wherein each impeller vane trailing edge attaches to the shroud of the impeller at a location about ⅔ of the length of the impeller vane trailing edge further downstream of the location where the impeller vane trailing edge attaches to the hub of the impeller.

A ninth embodiment, which is the ESP assembly of any of the first through the eighth embodiment, wherein the ESP assembly further comprises a gas separator disposed between the seal section and the centrifugal pump assembly, wherein a fourth drive shaft of the gas separator is mechanically coupled to the second drive shaft and to the third drive shaft, whereby the third drive shaft is indirectly coupled to the second drive shaft via the fourth drive shaft.

A tenth embodiment, which is the ESP assembly of any of the first through the ninth embodiment, wherein the impeller vane trailing edge defines a convex shape and the diffuser vane leading edge defines a concave shape.

An eleventh embodiment, which is the ESP assembly of any of the first through the ninth embodiment, wherein the impeller vane trailing edge defines a concave shape and the diffuser vane leading edge defines a convex shape.

A twelfth embodiment, which is the ESP assembly of any of the first through the ninth embodiment, wherein the impeller vane trailing edge defines a straight path and the diffuser vane leading edge defines a straight path.

A thirteenth embodiment, which is a method of lifting fluid in a wellbore comprising running an electrical submersible pump (ESP) assembly into a wellbore, wherein the ESP assembly comprises an electric motor having a first drive shaft, a seal unit having a second drive shaft coupled to the first drive shaft, and a centrifugal pump assembly comprising a housing, a third drive shaft disposed within the housing coupled directly or indirectly to the second drive shaft, and a plurality of pump stages, wherein each pump stage comprises a diffuser retained by the housing and an impeller mechanically coupled to the drive shaft, wherein the impeller comprises a plurality of impeller vanes, wherein each impeller vane attaches to a hub of the impeller at a first edge of the impeller vane and attaches to a shroud of the impeller at a second edge of the impeller vane opposite the first edge of the impeller vane, wherein each impeller vane has an impeller vane trailing edge that attaches to the shroud of the impeller at a location downstream of a location where the impeller vane trailing edge attaches to the hub of the impeller, and wherein the diffuser comprises a plurality of diffuser vanes, wherein each diffuser vane attaches to a hub of the diffuser at a first edge of the diffuser vane and attaches to a shroud of the diffuser at a second edge of the diffuser vane opposite the first edge of the diffuser vane, wherein each diffuser vane has a diffuser vane leading edge that attaches to the shroud of the diffuser at a location downstream of a location where the diffuser vane leading edge attaches to the hub of the diffuser; providing electrical power to the electric motor; turning the centrifugal pump assembly by the electric motor; and lifting fluid by the centrifugal pump up a production tubing fluidly coupled to a discharge of the centrifugal pump.

A fourteenth embodiment, which is the method of the thirteenth embodiment, wherein the impeller vanes of the impellers of the centrifugal pump stages provide a higher work output in the centrifugal pump lifting fluid up the production tubing than an equally sized centrifugal pump assembly using conventional pump stages.

A fifteenth embodiment, which is the method of the thirteenth or the fourteenth embodiment, wherein each impeller vane trailing edge attaches to the shroud of the impeller at a location about ⅓ of the length of the impeller vane trailing edge further downstream of the location where the impeller vane trailing edge attaches to the hub of the impeller.

A sixteenth embodiment, which is the method of the thirteenth or the fourteenth embodiment, wherein each impeller vane trailing edge attaches to the shroud of the impeller at a location about ½ of the length of the impeller vane trailing edge further downstream of the location where the impeller vane trailing edge attaches to the hub of the impeller.

A seventeenth embodiment, which is the method of the thirteenth or the fourteenth embodiment, wherein each impeller vane trailing edge attaches to the shroud of the impeller at a location about ⅔ of the length of the impeller vane trailing edge further downstream of the location where the impeller vane trailing edge attaches to the hub of the impeller.

An eighteenth embodiment, which is the method of the thirteenth or the fourteenth embodiment, wherein each impeller vane trailing edge attaches to the shroud of the impeller at a location from about ¼ of the length to about ¾ of the length of the impeller vane trailing edge further downstream of the location where the impeller vane trailing edge attaches to the hub of the impeller.

A nineteenth embodiment, which is the method of any of the thirteenth through the eighteenth embodiment, wherein the number of impeller vanes of each impeller is different than the number of diffuser vanes of each diffuser.

A twentieth embodiment, which is the method of any of the thirteenth through the eighteenth embodiment, wherein the number of impeller vanes of each impeller is less than the number of diffuser vanes of each diffuser.

A twenty-first embodiment, which is the method of any of the thirteenth through the eighteenth embodiment, wherein the number of impeller vanes of each impeller is greater than the number of diffuser vanes of each diffuser.

A twenty-second embodiment, which is the method of any of the thirteenth through the eighteenth embodiment, wherein the number of impeller vanes of each impeller is equal to the number of diffuser vanes of each diffuser.

A twenty-third embodiment, which is the method of any of the thirteenth through the twenty-second embodiment, wherein the impeller vane trailing edge defines a convex shape and the diffuser vane leading edge defines a concave shape.

A twenty-third embodiment, which is the method of any of the thirteenth through the twenty-second embodiment, wherein the impeller vane trailing edge defines a concave shape and the diffuser vane leading edge defines a convex shape.

A twenty-third embodiment, which is the method of any of the thirteenth through the twenty-second embodiment, wherein the impeller vane trailing edge defines a straight path and the diffuser vane leading edge defines a straight path.

A twenty-third embodiment, which is the method of any of the thirteenth through the twenty-second embodiment.

A twenty-fourth embodiment, which is a horizontal pump system (HPS) comprising an electric motor having a first drive shaft; and a centrifugal pump assembly comprising a housing, a second drive shaft disposed within the housing coupled directly or indirectly to the first drive shaft, and a plurality of pump stages, wherein each pump stage comprises a diffuser retained by the housing and an impeller mechanically coupled to the drive shaft, wherein the impeller comprises a plurality of impeller vanes, wherein each impeller vane attaches to a hub of the impeller at a first edge of the impeller vane and attaches to a shroud of the impeller at a second edge of the impeller vane opposite the first edge of the impeller vane, wherein each impeller vane has an impeller vane trailing edge that attaches to the shroud of the impeller at a location downstream of a location where the impeller vane trailing edge attaches to the hub of the impeller, and wherein the diffuser comprises a plurality of diffuser vanes, wherein each diffuser vane attaches to a hub of the diffuser at a first edge of the diffuser vane and attaches to a shroud of the diffuser at a second edge of the diffuser vane opposite the first edge of the diffuser vane, wherein each diffuser vane has a diffuser vane leading edge that attaches to the shroud of the diffuser at a location downstream of a location where the diffuser vane leading edge attaches to the hub of the diffuser.

A twenty-fifth embodiment, which is the HPS of the twenty-fourth embodiment, wherein each impeller vane trailing edge attaches to the shroud of the impeller at a location about ⅓ of the length of the impeller vane trailing edge further downstream of the location where the impeller vane trailing edge attaches to the hub of the impeller.

A twenty-sixth embodiment, which is the HPS of the twenty-fourth embodiment, wherein each impeller vane trailing edge attaches to the shroud of the impeller at a location from about ¼ of the length to about ¾ of the length of the impeller vane trailing edge further downstream of the location where the impeller vane trailing edge attaches to the hub of the impeller.

A twenty-seventh embodiment, which is the HPS of the any of the twenty-fourth through the twenty-sixth embodiment, wherein each diffuser vane leading edge attaches to the shroud of the diffuser at a distance downstream of where the diffuser vane leading edge attaches to the hub of the diffuser that is about a same distance as a distance downstream that each impeller vane trailing edge attaches to the shroud of the impeller versus where the impeller vane trailing edge attaches to the hub of the impeller.

A twenty-eighth embodiment, which is the HPS of any of the twenty-fourth through the twenty-seventh embodiment, wherein the number of impeller vanes of each impeller is different than the number of diffuser vanes of each diffuser.

A twenty-ninth embodiment, which is the HPS of any of the twenty-fourth through the twenty-seventh embodiment, wherein the number of impeller vanes of each impeller is less than the number of diffuser vanes of each diffuser.

A thirtieth embodiment, which is the HPS of any of the twenty-fourth through the twenty-seventh embodiment, wherein the number of impeller vanes of each impeller is greater than the number of diffuser vanes of each diffuser.

A thirty-first embodiment, which is the HPS of any of the twenty-fourth through the twenty-seventh embodiment, wherein the number of impeller vanes of each impeller is equal to the number of diffuser vanes of each diffuser.

A thirty-second embodiment, which is the HPS of any of the twenty-fourth through the thirty-first embodiment, wherein the impeller vane trailing edge defines a convex shape and the diffuser vane leading edge defines a concave shape.

A thirty-third embodiment, which is the HPS of any of the twenty-fourth through the thirty-first embodiment, wherein the impeller vane trailing edge defines a concave shape and the diffuser vane leading edge defines a convex shape.

A thirty-fourth embodiment, which is the HPS of any of the twenty-fourth through the thirty-first embodiment, wherein the impeller vane trailing edge defines a straight path and the diffuser vane leading edge defines a straight path.

A thirty-fifth embodiment, which is the HPS of any of the twenty-fourth through the thirty-first embodiment, wherein the impeller vane trailing edge defines a sinusoidal path and the diffuser vane leading edge defines a sinusoidal path.

A thirty-sixth embodiment, which is the HPS of any of the twenty-fourth through the thirty-first embodiment, wherein the impeller vane trailing edge defines a zig-zag path and the diffuser vane leading edge defines a zig-zag path.

A thirty-seventh embodiment, which is the HPS of any of the twenty-fourth through the thirty-first embodiment, wherein the impeller vane trailing edge defines a parabolic path.

A thirty-eighth embodiment, which is the ESP assembly of any of the first through the ninth embodiment, wherein the impeller vane trailing edge defines a sinusoidal path and the diffuser vane leading edge defines a sinusoidal path.

A thirty-ninth embodiment, which is the ESP assembly of any of the first through the ninth embodiment, wherein the impeller vane trailing edge defines a zig-zag path and the diffuser vane leading edge defines a zig-zag path.

A fortieth embodiment, which is the ESP assembly of any of the first through the ninth embodiment, wherein the impeller vane trailing edge defines a parabolic path.

A forty-first embodiment, which is the ESP assembly of any of the first through the ninth embodiment, wherein the impeller vane trailing edge defines a convex shape.

A forty-second embodiment, which is the ESP assembly of any of the first through the ninth embodiment, wherein the impeller vane trailing edge defines a concave shape.

A forty-third embodiment, which is the ESP assembly of any of the first through the ninth embodiment, wherein the impeller vane trailing edge defines a straight path.

A forty-fourth embodiment, which is the ESP assembly of any of the first through the ninth embodiment or any of the forty-first through the forty-third embodiment, wherein the diffuser vane leading edge defines a concave shape.

A forty-fifth embodiment, which is the ESP assembly of any of the first through the ninth embodiment or any of the forty-first through the forty-third embodiment, wherein the diffuser vane leading edge defines a convex shape.

A forty-sixth embodiment, which is the ESP assembly of any of the first through the ninth embodiment or any of the forty-first through the forty-third embodiment, wherein the diffuser vane leading edge defines a straight path.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) assembly, comprising:

an electric motor having a first drive shaft;

a seal unit having a second drive shaft coupled to the first drive shaft; and a centrifugal pump assembly having a central axis aligned parallel with a y-axis of a set of X, y, z orientation axes and comprising a housing, a third drive shaft disposed within the housing coupled directly or indirectly to the second drive shaft, and a plurality of pump stages, wherein each pump stage comprises a diffuser retained by the housing and an impeller mechanically coupled to the third drive shaft, wherein the impeller comprises an impeller hub, an impeller shroud, and a plurality of impeller vanes, wherein each impeller vane has an impeller vane first edge and an impeller vane second edge opposite the impeller vane first edge, the impeller vane first edge attaches to the impeller hub, and the impeller vane second edge attaches to the impeller shroud, wherein each impeller vane has an impeller vane trailing edge that attaches to the impeller shroud at an impeller vane trailing edge shroud attachment point and attaches to the impeller hub at an impeller vane trailing edge hub attachment point, wherein the impeller vane trailing edge shroud attachment point is disposed axially in a positive direction along the y-axis from the impeller vane trailing edge hub attachment point, and wherein the diffuser comprises a diffuser hub, a diffuser shroud, and a plurality of diffuser vanes, wherein each diffuser vane has a diffuser vane first edge and a diffuser vane second edge opposite the diffuser vane first edge, the diffuser vane first edge attaches to the diffuser hub, and the diffuser vane second edge attaches to the diffuser shroud, wherein each diffuser vane has a diffuser vane leading edge that attaches to the diffuser shroud at a diffuser vane leading edge shroud attachment point and attaches to the diffuser hub at a diffuser vane leading edge hub attachment point, wherein the diffuser vane leading edge shroud attachment point is disposed axially in the positive direction along the y-axis from the diffuser vane leading edge hub attachment point.

2. The ESP assembly of claim 1, wherein a number of the plurality of impeller vanes of each impeller is different than a number of the plurality of diffuser vanes of each diffuser.

3. The ESP assembly of claim 1, wherein a number of the plurality of impeller vanes of each impeller is equal to a number of the plurality of diffuser vanes of each diffuser.

4. The ESP assembly of claim 1, wherein a length of a portion of the impeller vane second edge disposed in the positive direction along the y-axis from the impeller vane trailing edge hub attachment point is between 15% and 95% of a length of the impeller vane trailing edge.

5. The ESP assembly of claim 1, wherein a length of a portion of the impeller vane second edge disposed in the positive direction along the y-axis from the impeller vane trailing edge hub attachment point is between 30% and 50% of a length of the impeller vane trailing edge.

6. The ESP assembly of claim 1, wherein a length of a portion of the impeller vane second edge disposed in the positive direction along the y-axis from the impeller vane trailing edge hub attachment point is between 50% and 75% of a length of the impeller vane trailing edge.

7. The ESP assembly of claim 1, wherein the impeller vane trailing edge of each of the plurality of impeller vanes defines a convex shape between the impeller vane trailing edge shroud attachment point and the impeller vane trailing edge hub attachment point.

8. The ESP assembly of claim 1, wherein the impeller vane trailing edge of each of the plurality of impeller vanes defines a concave shape between the impeller vane trailing edge shroud attachment point and the impeller vane trailing edge hub attachment point.

9. The ESP assembly of claim 1, wherein the impeller vane trailing edge of each of the plurality of impeller vanes defines a straight path between the impeller vane trailing edge shroud attachment point and the impeller vane trailing edge hub attachment point.

10. The ESP assembly of claim 1, wherein the diffuser vane leading edge of each of the plurality of diffuser vanes defines a concave shape between the diffuser vane leading edge shroud attachment point and the diffuser vane leading edge hub attachment point.

11. The ESP assembly of claim 1, wherein the diffuser vane leading edge of each of the plurality of diffuser vanes defines a convex shape between the diffuser vane leading edge shroud attachment point and the diffuser vane leading edge hub attachment point.

12. The ESP assembly of claim 1, wherein the diffuser vane leading edge of each of the plurality of diffuser vanes defines a straight path between the diffuser vane leading edge shroud attachment point and the diffuser vane leading edge hub attachment point.

13. The ESP assembly of claim 1, wherein the diffuser vane leading edge shroud attachment point of each of the plurality of diffuser vanes is disposed axially in the positive direction along the y-axis about a same first distance from the diffuser vane leading edge hub attachment point as a second distance that the impeller trailing edge shroud attachment point is disposed axially in the positive direction along the y-axis from the impeller vane trailing edge hub attachment point.

14. A method of lifting fluid in a wellbore, comprising:

running an electrical submersible pump (ESP) assembly into a wellbore, wherein the ESP assembly comprises an electric motor having a first drive shaft, a seal unit having a second drive shaft coupled to the first drive shaft, and a centrifugal pump assembly having a central axis aligned parallel with a y-axis of a set of x, y, z orientation axes and comprising a housing, a third drive shaft disposed within the housing coupled directly or indirectly to the second drive shaft, and a plurality of pump stages, wherein each pump stage comprises a diffuser retained by the housing and an impeller mechanically coupled to the third drive shaft, wherein the impeller comprises an impeller hub, an impeller shroud, and a plurality of impeller vanes, wherein each impeller vane has an impeller vane first edge and an impeller vane second edge opposite the impeller vane first edge, the impeller vane first edge attaches to the impeller hub, and the impeller vane second edge attaches to the impeller shroud, wherein each impeller vane has an impeller vane trailing edge that attaches to the impeller shroud at an impeller vane trailing edge shroud attachment point and attaches to the impeller hub at an impeller vane trailing edge hub attachment point, wherein the impeller vane trailing edge shroud attachment point is disposed axially in a positive direction along the y-axis from the impeller vane trailing edge hub attachment point, and wherein the diffuser comprises a diffuser hub, a diffuser shroud, and a plurality of diffuser vanes, wherein each diffuser vane has a diffuser vane first edge and a diffuser vane second edge opposite the diffuser vane first edge, the diffuser vane first edge attaches to the diffuser hub, and the diffuser vane second edge attaches to the diffuser shroud, wherein each diffuser vane has a diffuser vane leading edge that attaches to the diffuser shroud at a diffuser vane leading edge shroud attachment point and attaches to the diffuser hub at a diffuser vane leading edge hub attachment point, wherein the diffuser vane leading edge shroud attachment point is disposed axially in the positive direction along the y-axis from the diffuser vane leading edge hub attachment point;

providing electrical power to the electric motor;

turning the centrifugal pump assembly by the electric motor; and lifting fluid by the centrifugal pump up a production tubing fluidly coupled to a discharge of the centrifugal pump.

15. The method of claim 14, wherein the impeller vane trailing edge of each of the plurality of impeller vanes defines a convex shape between the impeller vane trailing edge shroud attachment point and the impeller vane trailing edge hub attachment point.

16. The method of claim 14, wherein a length of a portion of the impeller vane second edge disposed in the positive direction along the y-axis from the impeller vane trailing edge hub attachment point is between 15% and 95% of a length of the impeller vane trailing edge.

17. The method of claim 14, wherein a length of a portion of the impeller vane second edge disposed in the positive direction along the y-axis from the impeller vane trailing edge hub attachment point is between 30% and 50% of a length of the impeller vane trailing edge.

18. The method of claim 14, wherein a length of a portion of the impeller vane second edge disposed in the positive direction along the y-axis from the impeller vane trailing edge hub attachment point is between 50% and 75% of a length of the impeller vane trailing edge.

19. The method of claim 14, wherein the impeller vane trailing edge of each of the plurality of impeller vanes defines a concave shape between the impeller vane trailing edge shroud attachment point and the impeller vane trailing edge hub attachment point.

20. A horizontal pump system (HPS), comprising:

an electric motor having a first drive shaft;

a centrifugal pump assembly having a central axis aligned parallel with a y-axis of a set of x, y, z orientation axes and comprising a housing, a second drive shaft disposed within the housing coupled directly or indirectly to the first drive shaft, and a plurality of pump stages, wherein each pump stage comprises a diffuser retained by the housing and an impeller mechanically coupled to the second drive shaft, wherein the impeller comprises an impeller hub, an impeller shroud, and a plurality of impeller vanes, wherein each impeller vane has an impeller vane first edge and an impeller vane second edge opposite the impeller vane first edge, the impeller vane first edge attaches to the impeller hub, and the impeller vane second edge attaches to the impeller shroud, wherein each impeller vane has an impeller vane trailing edge that attaches to the impeller shroud at an impeller vane trailing edge shroud attachment point and attaches to the impeller hub at an impeller vane trailing edge hub attachment point, wherein the impeller vane trailing edge shroud attachment point is disposed axially in a positive direction along the y-axis from the impeller vane trailing edge hub attachment point, and wherein the diffuser comprises a diffuser hub, a diffuser shroud, and a plurality of diffuser vanes, wherein each diffuser vane has a diffuser vane first edge and a diffuser vane second edge opposite the diffuser vane first edge, the diffuser vane first edge attaches to the diffuser hub, and the diffuser vane second edge attaches to the diffuser shroud, wherein each diffuser vane has a diffuser vane leading edge that attaches to the diffuser shroud at a diffuser vane leading edge shroud attachment point and attaches to the diffuser hub at a diffuser vane leading edge hub attachment point, wherein the diffuser vane leading edge shroud attachment point is disposed axially in the positive direction along the y-axis from the diffuser vane leading edge hub attachment point.

21. The HPS of claim 20, wherein a length of a portion of the impeller vane second edge disposed in the positive direction along the y-axis from the impeller vane trailing edge hub attachment point is between 15% and 95% of a length of the impeller vane trailing edge.

22. The HPS of claim 20, wherein a length of a portion of the impeller vane second edge disposed in the positive direction along the y-axis from the impeller vane trailing edge hub attachment point is between 30% and 50% of a length of the impeller vane trailing edge.

23. The HPS of claim 20, wherein the diffuser vane leading edge shroud attachment point of each of the plurality of diffuser vanes is disposed axially in the positive direction along the y-axis about a same first distance from the diffuser vane leading edge hub attachment point as a second distance that the impeller trailing edge shroud attachment point is disposed axially in the positive y-direction along the y-axis from the impeller vane trailing edge hub attachment point.

* * * * *